US008235076B2

(12) United States Patent
Coignet et al.

(10) Patent No.: US 8,235,076 B2
(45) Date of Patent: Aug. 7, 2012

(54) METHOD AND SYSTEM FOR OPTIMIZED FILLING OF AN ENCLOSURE

(75) Inventors: Philippe A. Coignet, Bear, DE (US); Pascal J. Tromeur, Wilmington, DE (US); Justin J. Wang, Newark, DE (US)

(73) Assignee: American Air Liquide, Inc., Fremont, CA (US)

( * ) Notice: Subject to any disclaimer, the term of this patent is extended or adjusted under 35 U.S.C. 154(b) by 394 days.

(21) Appl. No.: 12/472,110

(22) Filed: May 26, 2009

(65) Prior Publication Data

US 2010/0193067 A1 Aug. 5, 2010

Related U.S. Application Data

(60) Provisional application No. 61/149,210, filed on Feb. 2, 2009.

(51) Int. Cl.
*B65B 1/04* (2006.01)

(52) U.S. Cl. ..... 141/4; 141/59; 141/63; 141/129; 156/382; 156/580

(58) Field of Classification Search ..... 141/4, 67, 141/59, 63, 129; 156/382, 580
See application file for complete search history.

(56) References Cited

U.S. PATENT DOCUMENTS

| | | | | |
|---|---|---|---|---|
| 4,886,095 | A * | 12/1989 | Lisec | 141/4 |
| 5,080,146 | A * | 1/1992 | Arasteh | 141/4 |
| 5,110,337 | A * | 5/1992 | Lisec | 65/58 |
| 5,350,469 | A * | 9/1994 | Lenhardt et al. | 156/102 |
| 5,676,736 | A | 10/1997 | Crozel | |
| 5,735,318 | A * | 4/1998 | Vianello | 141/67 |
| 5,762,739 | A | 6/1998 | Lenhardt et al. | |
| 6,397,662 | B1 | 6/2002 | Alkhoury | |
| 6,622,456 | B2 | 9/2003 | Almasy | |
| 6,795,178 | B1 | 9/2004 | Rasanen et al. | |
| 7,231,809 | B2 * | 6/2007 | Susko | 73/31.05 |
| 2003/0085238 | A1 | 5/2003 | Segro | |
| 2007/0103686 | A1 | 5/2007 | Tornkvist et al. | |

FOREIGN PATENT DOCUMENTS

| | | |
|---|---|---|
| DE | 39 14 706 | 12/1989 |
| DE | 44 19 052 | 12/1995 |
| WO | WO 89 03925 | 5/1989 |

OTHER PUBLICATIONS

International Search Report and Written Opinion for related PCT/IB2010/050418, May 25, 2010.

* cited by examiner

*Primary Examiner* — Dinh Q Nguyen
(74) *Attorney, Agent, or Firm* — Allen E. White; Elwood L. Haynes

(57) ABSTRACT

An enclosure is filled with a filling gas according to the disclosed method. An enclosure is provided having an interior, a width, a height, a thickness, and fluid filling and exit holes fluidly communicating with the interior. Filling of the enclosure is commenced by directing a flow of the filling gas at a filling flow rate into the fluid filling hole. An oxygen concentration of gas exiting the fluid exit hole is sensed. The filling of the enclosure is stopped when the sensed oxygen concentration reaches a threshold concentration, wherein the threshold oxygen concentration and/or the filling flow rate are selected by a Decision Support Tool based upon the width, height, and/or the thickness.

21 Claims, 9 Drawing Sheets

Figure 4: Oxygen content (% per volume) at the interpane exit gas stream. Impact of the sensor response time on gas loss.

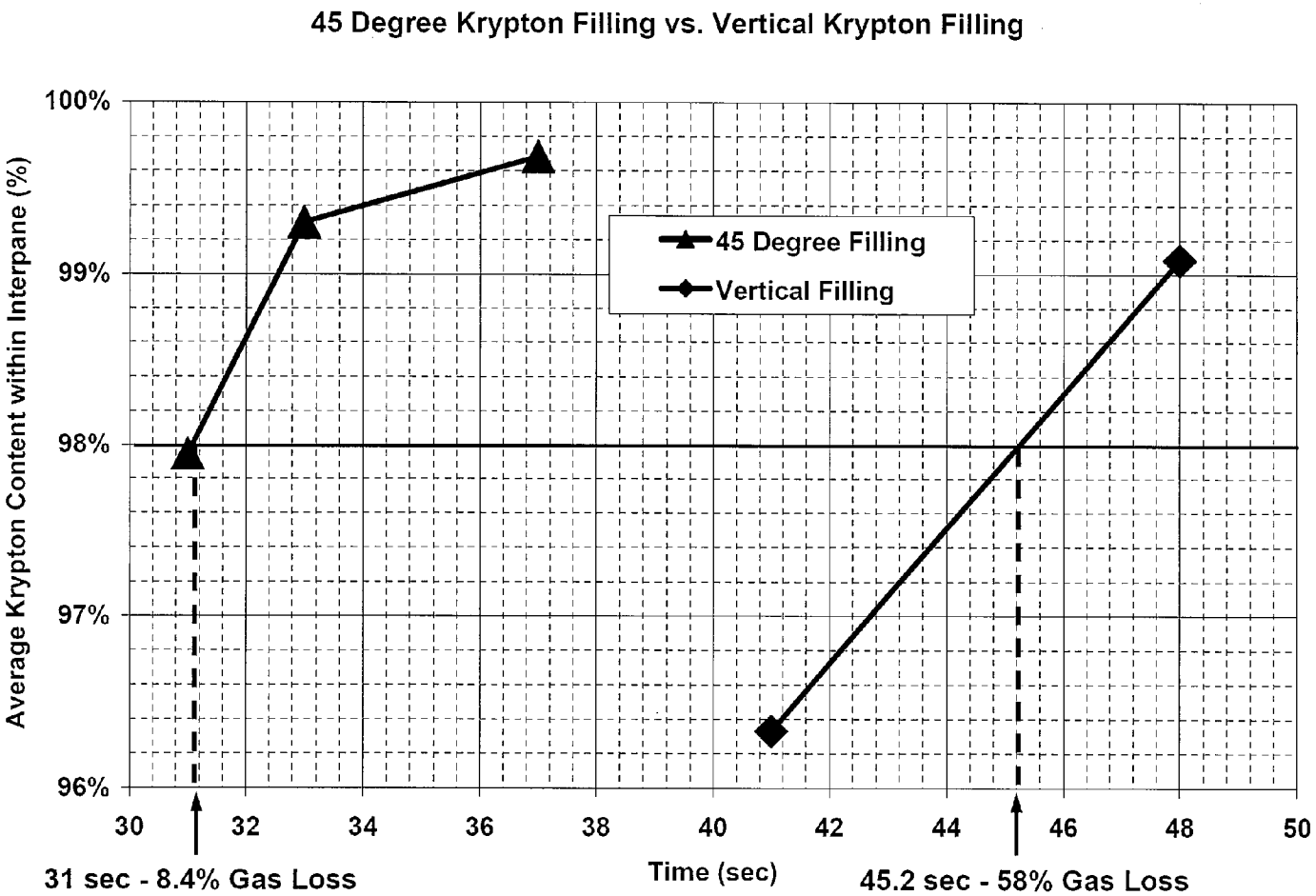
Figure 6: Impact of 45 degree filling on filling duration and gas loss at 98% gas content.

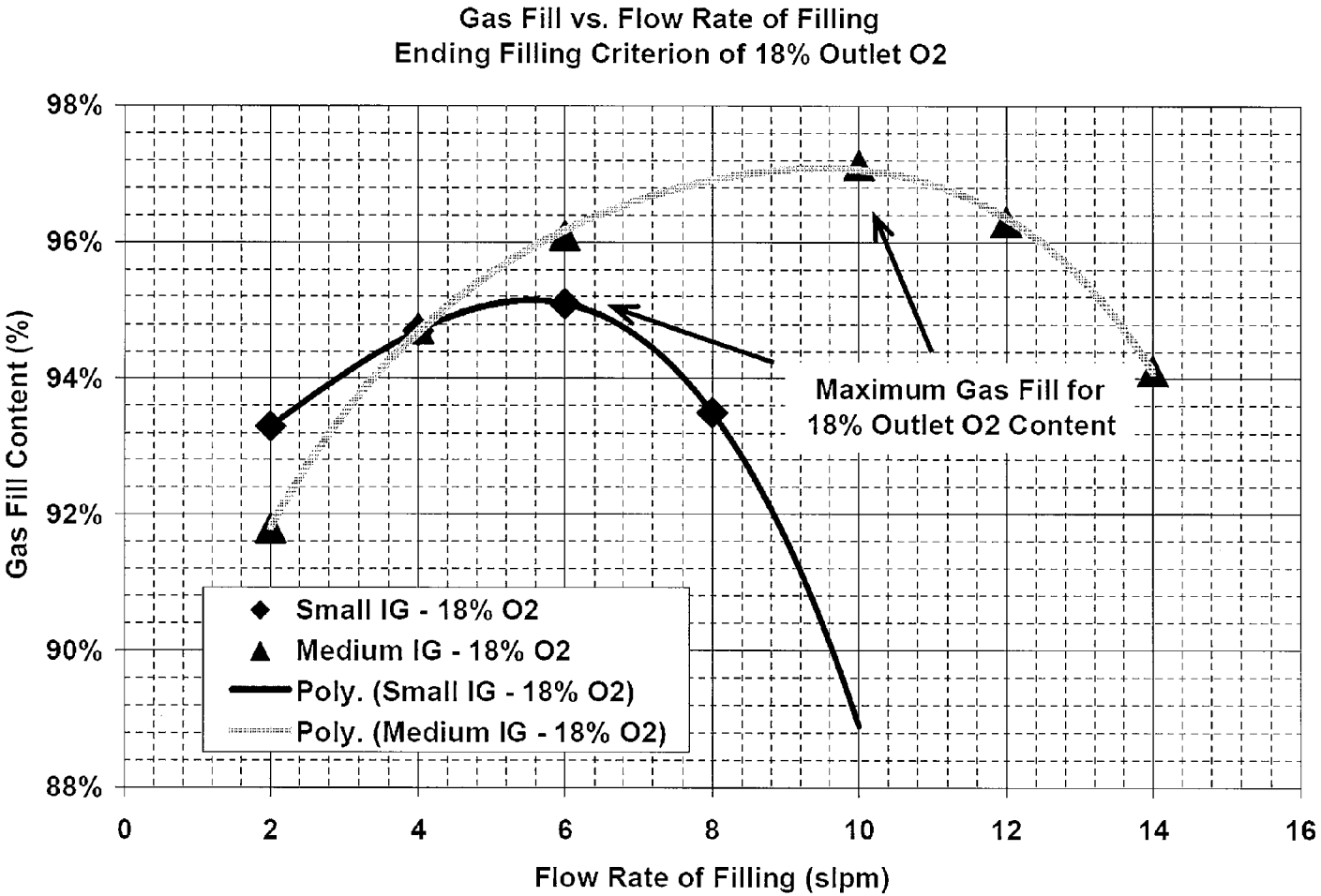
Figure 7: Selection of the optimum Kr filling conditions for the small and medium size square units.

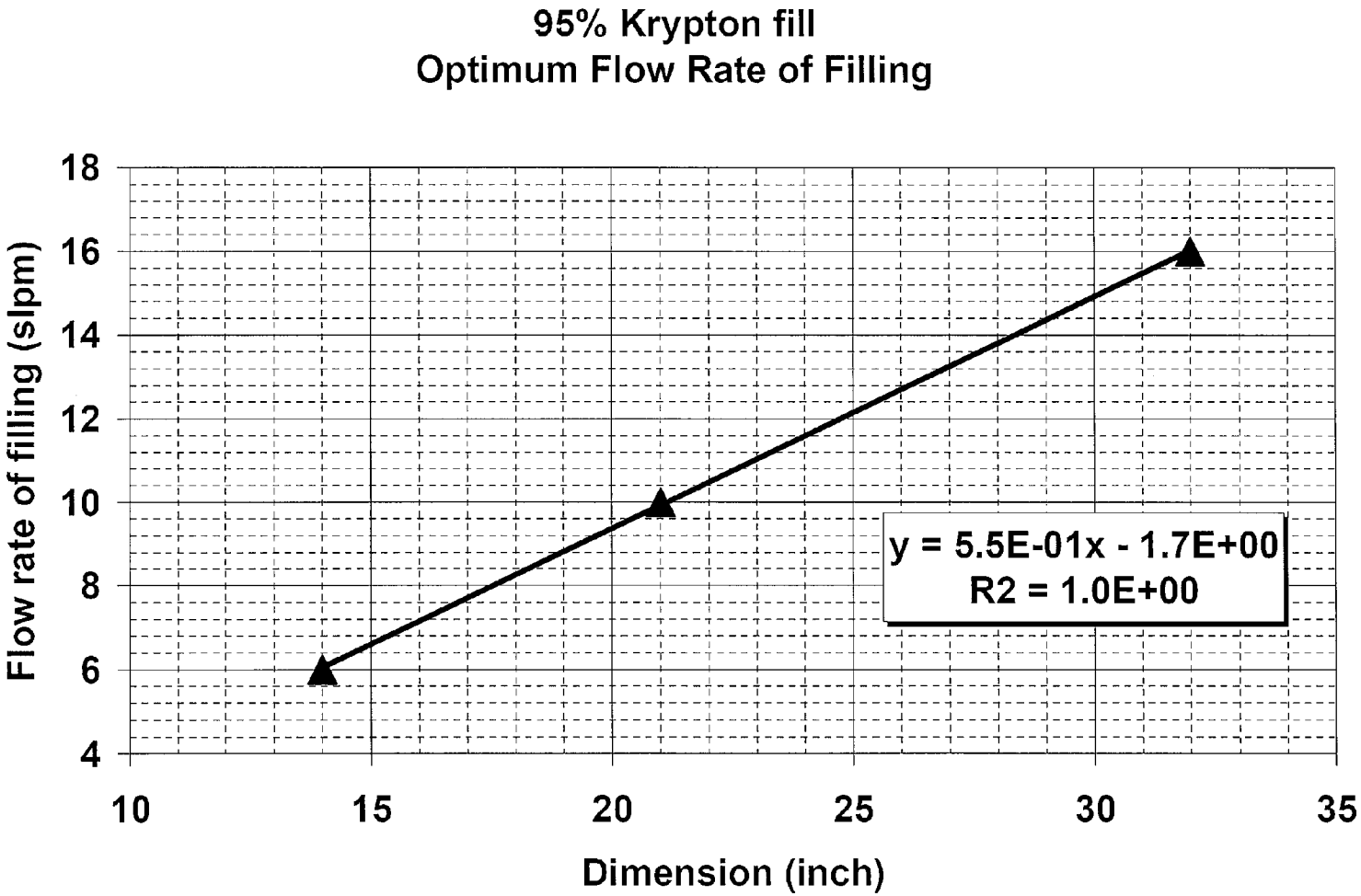
Figure 8: Decision Support Tool tailored for a minimum 95% krypton filling of a 3/8" interpane

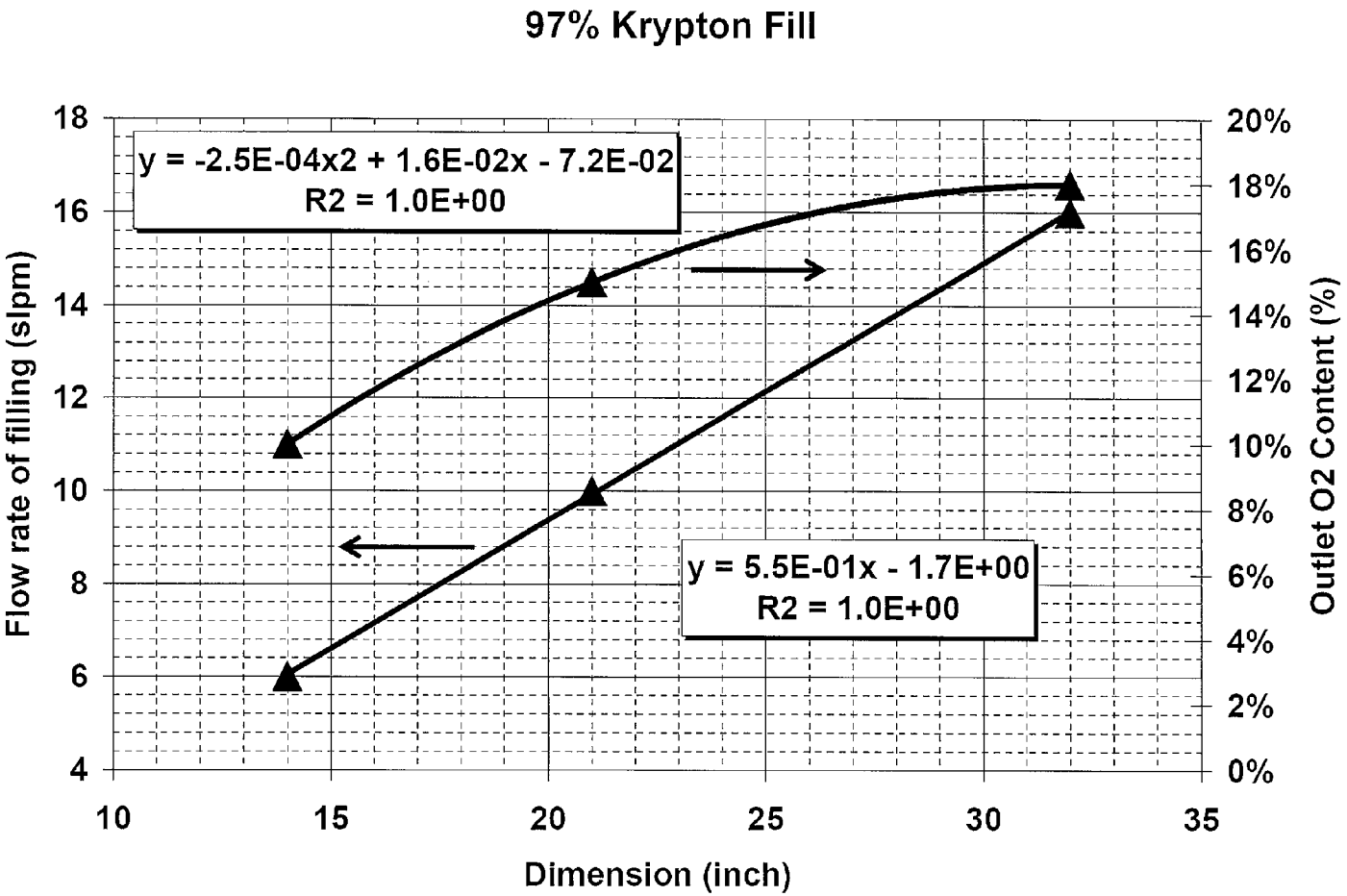
Figure 9: Decision Support Tool tailored for a 97% krypton filling of a 3/8" interpane

METHOD AND SYSTEM FOR OPTIMIZED FILLING OF AN ENCLOSURE

CROSS-REFERENCE TO RELATED APPLICATIONS

This patent application claims the benefit of U.S. Provisional Patent Application No. 61/149,210 filed Feb. 2, 2009.

BACKGROUND

Many different types of enclosures are filled with a gas for various purposes. Two examples of such enclosures include fluorescent light bulbs and insulated glass units (IGU). IGUs are window structures having two or more panes arranged in parallel with a gas (typically air, a noble gas, or mixtures thereof). Desirable conditions for filling an enclosure with a gas is one that limits gas loss while ensuring a short filling duration and maximum gas content. A low gas loss can be obtained by slow flow rates of filling, but result in long filling duration. Of course, the filling duration can be shortened by increasing the flow rate of filling. However, increasing the flow rate will increase the gas loss. Thus, there is a need for a way to determine an optimum flow rate of filling that limits gas loss but still enables a fast filling and a maximum gas fill (high concentration of the intended gas).

Some conventional IGU filling machines use thermal sensors in order to assess how much of the intended gas has been filled into the enclosure. However, these types of sensor are relatively slow acting which leads to high gas loss. Other conventional filling methods propose the use of a paramagnetic $O_2$ sensor. However this type of sensor has several disadvantages. It is expensive. It restricts the flow of gas and thus requires a vacuum pump to draw small samples out of the IGU being filled. It can also be relatively fragile and sensitive to being bumped. Finally, the paramagnetic $O_2$ sensor can be relatively bulky which requires the sensor to operate "far" (e.g. 10 feet) from the interpane being filled. Because the gas has to flow from the window to the sensor through a dedicated sampling line, there is a delay in sensing the outlet window composition. This time delay translates into gas loss. Thus, there is a need for an improved type of sensor for use in IGU filling machines.

Conventional manual filling processes can generate gas losses ranging from 30% to 200% or more, with an average minimum gas loss of 50%. An additional problem is that these processes often will use the same filling flow rate for all sizes and shapes of IGUs. The gas loss problem has not been a tremendous problem, because most of the current manual filling processes have been developed for cheap filling gases such as Argon. With more expensive gases containing Krypton and/or Xenon, it becomes more important to limit gas losses as much as possible in order to lower the cost of filling.

The patent literature includes some method and systems associated with filling enclosures with gases.

U.S. Pat. No. 5,080,146 (Arasteh) discloses a method for filling insulated glazing units. The method utilizes a vacuum chamber in which the insulated glazing units are placed. The insulated glazing units and vacuum chamber are evacuated simultaneously. The units are then refilled with a low conductance gas such as Krypton while the chamber is simultaneously refilled with air. However, the automated multi-step process is time consuming U.S. Pat. No. 6,622,456 B2 (Almasy) discloses a method for filling insulating glass units with gases other than air by dispensing cryogenic liquids into the inner space of these units which then evaporates to the gaseous state is disclosed.

U.S. Pat. No. 5,676,736 (Crozel) discloses a two step process for introducing a filling gas (e.g. rare gas mixture) into an enclosure. Initially, the enclosure contains a holding gas (e.g. air). In a first step, a purge gas (e.g. helium), easily extractable from both holding gas and filling gas, is introduced into the enclosure until the holding gas is totally removed from the enclosure. In a second step, the filling gas is injected into the enclosure until a portion or the whole purge gas is removed from the enclosure. The filling gas lost during the second process can then be recycled, thus limiting the manufacturing cost. Optionally, the purge gas can be separated from the holding gas and recycled as well. Proposed methods of separation include permeation (membrane), adsorption, absorption and distillation. Proposed purge gases include Argon, carbon dioxide, Helium and Hydrogen. Proposed filling gases include Argon, Neon, Krypton and Xenon.

In view of the disadvantages posed by conventional methods and systems for filling enclosures (especially IGUs) with a gas, there is a need for an improved method and system which overcomes or does not exhibit these disadvantages.

SUMMARY

There is disclosed a method of filling an enclosure with a filling gas that includes the following steps. An enclosure is provided having an interior, a width, a height, a thickness, and fluid filling and exit holes fluidly communicating with the interior. Filling of the enclosure is commenced by directing a flow of the filling gas at a filling flow rate into the fluid filling hole. An oxygen concentration of gas exiting the fluid exit hole is sensed. The filling of the enclosure is stopped when the sensed oxygen concentration reaches a threshold concentration, wherein the threshold oxygen concentration and/or the filling flow rate are selected by a Decision Support Tool based upon the width, height, and/or the thickness.

There is also disclosed a system for filling an enclosure with a filling gas that includes: a filling lance adapted to be inserted into a fluid filling hole formed in one end of the enclosure; an oxygen sensor disposed adjacent a fluid exit hole formed in an opposite end of the enclosure; and a controller being written with an algorithm. The controller is adapted to: receive an oxygen concentration sensed by said oxygen sensor; have a height, width and/or a thickness of the enclosure be inputted; and select a flow rate of the filling gas during filling of the enclosure and/or a threshold oxygen concentration. The selection is based upon the height, width and/or a thickness of the enclosure to be filled that is inputted to the controller. The selection is performed by the algorithm. The controller is further adapted to and stop filling of the enclosure by said filling lance once the oxygen concentration sensed by said oxygen sensor reaches the threshold oxygen concentration that is either selected by the algorithm or predetermined and inputted to the controller by an operator.

The disclosed method and/or system may include one or more of the following aspects:

- the threshold oxygen concentration is predetermined and the filling flow rate is selected by the Decision Support Tool based upon the width, height, and/or the thickness.
- the filling flow rate is predetermined and the threshold oxygen concentration is selected by the Decision Support Tool based upon the width, height, and/or the thickness.
- both the filling flow rate and the threshold oxygen concentration are selected by the Decision Support Tool based upon the width, height, and/or the thickness.

the method includes the further steps of:

predetermining a minimum concentration of the filling gas to be obtained inside the enclosure; and predetermining a maximum percent loss of the filling gas to occur during said filling, wherein the filling flow rate and threshold oxygen concentration selected by the Decision Support tool are further based upon the predetermined minimum concentration and predetermined maximum percent loss.

the method includes the further step of:

predetermining a minimum concentration of the filling gas to be obtained inside the enclosure, wherein the filling flow rate or threshold oxygen concentration selected by the Decision Support Tool is further based upon the predetermined minimum filling gas concentration.

the method includes the further step of:

predetermining a maximum percent loss of the filling gas to occur during said filling, wherein the filling flow rate or threshold oxygen concentration selected by the Decision Support Tool is further based upon the predetermined maximum percent loss.

the method includes the further step of:

predetermining a maximum filling duration defined by a time interval between said commencement and stopping of the filling, wherein the filling flow rate or threshold oxygen concentration selected by the Decision Support Tool is further based upon the predetermined maximum filling duration.

the Decision Support Tool selects the flow rate of the filling gas based the width, height, and/or the thickness and a composition of the filling gas.

the enclosure is an insulated glass unit comprising at least two square, triangular, semicircular or rectangular glass panes aligned with and parallel to one another and a sealing structure extending around a periphery of the panes and over an interpane space defined by the panes, the fluid filling and exit holes being formed in the sealing structure adjacent opposite corners of the sealing structure.

during said filling of the enclosure a bottom edge of the enclosure forms an angle $\alpha$ with respect to horizontal, said angle $\alpha$ being in a range of from 1° to 179°, the fluid exit hole being higher vertically than the fluid filling hole.

$\alpha$ is in a range of from 5° to 175°.

the oxygen concentration is sensed by an optically-based oxygen sensor.

a response time of the sensor is less than 1 second.

the sensor is disposed inside, or adjacent to, the fluid exit hole.

the filling gas is selected from the group consisting of Argon, Argon-enriched air, Neon, Neon-enriched air, Krypton, Krypton-enriched air, Xenon, Xenon-enriched air, and mixtures thereof.

the method includes the further steps of:

causing the height and/or width to be inputted to a controller;

selecting the filling flow rate with the controller, wherein the Decision Support Tool is an algorithm written to the controller.

the method includes the further step of applying a vacuum to the fluid exit hole, wherein:

the threshold oxygen concentration is selected by the Decision Support Tool based upon the width, height, and/or the thickness;

the filling flow rate is predetermined based upon a filling flow rate selected by an operator that compensates for the increase in the flow of filling gas through the enclosure that is produced by said vacuum application.

the system further includes a source of filling gas fluidly communicating with said filling lance, said filling gas being selected from the group consisting of Argon, Argon-enriched air, Neon, Neon-enriched air, Krypton, Krypton-enriched air, Xenon, Xenon-enriched air, and mixtures thereof.

the controller is further adapted to have a filling parameter inputted by an operator thereinto, said filling parameter being selected from the group consisting of a minimum concentration of the filling gas to be obtained in the enclosure, a maximum percent loss of the filling gas to occurs during filling, a maximum filling duration defined by a time interval between commencement and stopping of filling the enclosure with the filling gas, and a composition of the filling gas, wherein the flow rate is further based upon said filling parameter.

the system further includes a vacuum tube and a vacuum pump in vacuum communication with said tube, said sensor being at least partially disposed within said vacuum tube, said tube being adapted to be placed in vacuum communication with the fluid exit hole.

BRIEF DESCRIPTION OF THE DRAWINGS

For a further understanding of the nature and objects of the present invention, reference should be made to the following detailed description, taken in conjunction with the accompanying drawings, in which like elements are given the same or analogous reference numbers and wherein:

FIG. 6 is a graph showing the impact of 45 degree filling on filling duration and gas loss at 98% gas content.

FIG. 7 is a graph showing selection of the optimum Kr filling conditions for the small and medium size square units.

FIG. 8 is a graph showing the Decision Support Tool tailored for a minimum 95% krypton filling of a ⅜" interpane.

FIG. 9 is a graph showing Decision Support Tool tailored for a 97% krypton filling of a ⅜" interpane.

DESCRIPTION OF PREFERRED EMBODIMENTS

The disclosed method and system allow an enclosure to be filled with a filling gas with an optimal filling flow rate or optimal threshold Oxygen concentration. A desirable filling is one that limits gas loss and/or allows a short filling duration and/or allows a sufficiently high filling gas concentration at completion of filling. Low gas losses can be obtained by slow flow rates of filling, but will result in a long filling duration. On the other hand, the filling duration can be shortened by increasing the flow rate of filling, but will increase the gas loss. There is therefore an optimum way to fill the enclosure that can limit gas loss and/or enable a fast filling and/or allow a sufficiently high filling gas concentration.

The enclosure can be any type of enclosure enclosing a hollow space for containing a filling gas. Preferably, the enclosure is polyhedral, i.e., a three-dimensional shape having flat faces and straight edges. More preferably, the enclosure has a height, width, and thickness and is: a triangular prism (i.e., having a triangular cross-section and constant thickness); right rectangular prism (i.e., box-shaped); or a semicircular prism (i.e., having a semicircular cross-section and constant thickness). The right rectangular prism may have a constant thickness and either a rectangular or square cross-section. The enclosure has a filling hole for introducing a filling gas thereinto. The enclosure also has an exit allowing escape of gas contained within the enclosure during filling thereof. When the filling and exit holes are plugged or covered, the enclosure is relatively gas-tight.

While the filling gas may be any gas, its composition ultimately depends upon which type of enclosure is being filled. The disclosed method and system are especially applicable to filling gases that are relatively expensive, such as Krypton, Argon, Xenon, Neon, Krypton-enriched air, Argon-enriched air, Xenon-enriched air, Neon-enriched air, and mixtures thereof. Filling gases comprising air and one or more of Krypton, Argon, Xenon, or Neon preferably include less than 50% air.

Figure 1:
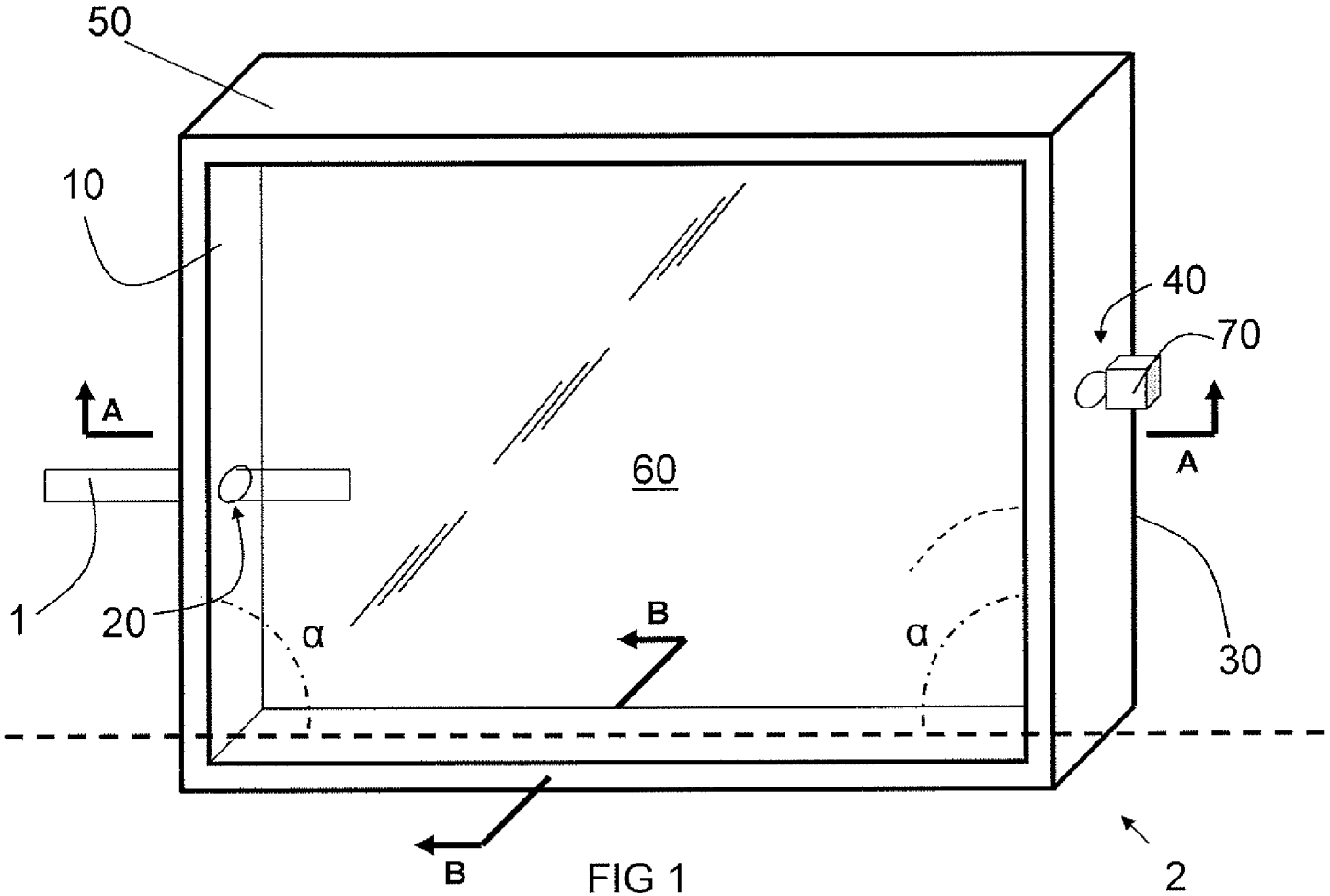
FIG. 1 is a schematic of a preferred type of enclosure to be filled.
Figure 2:
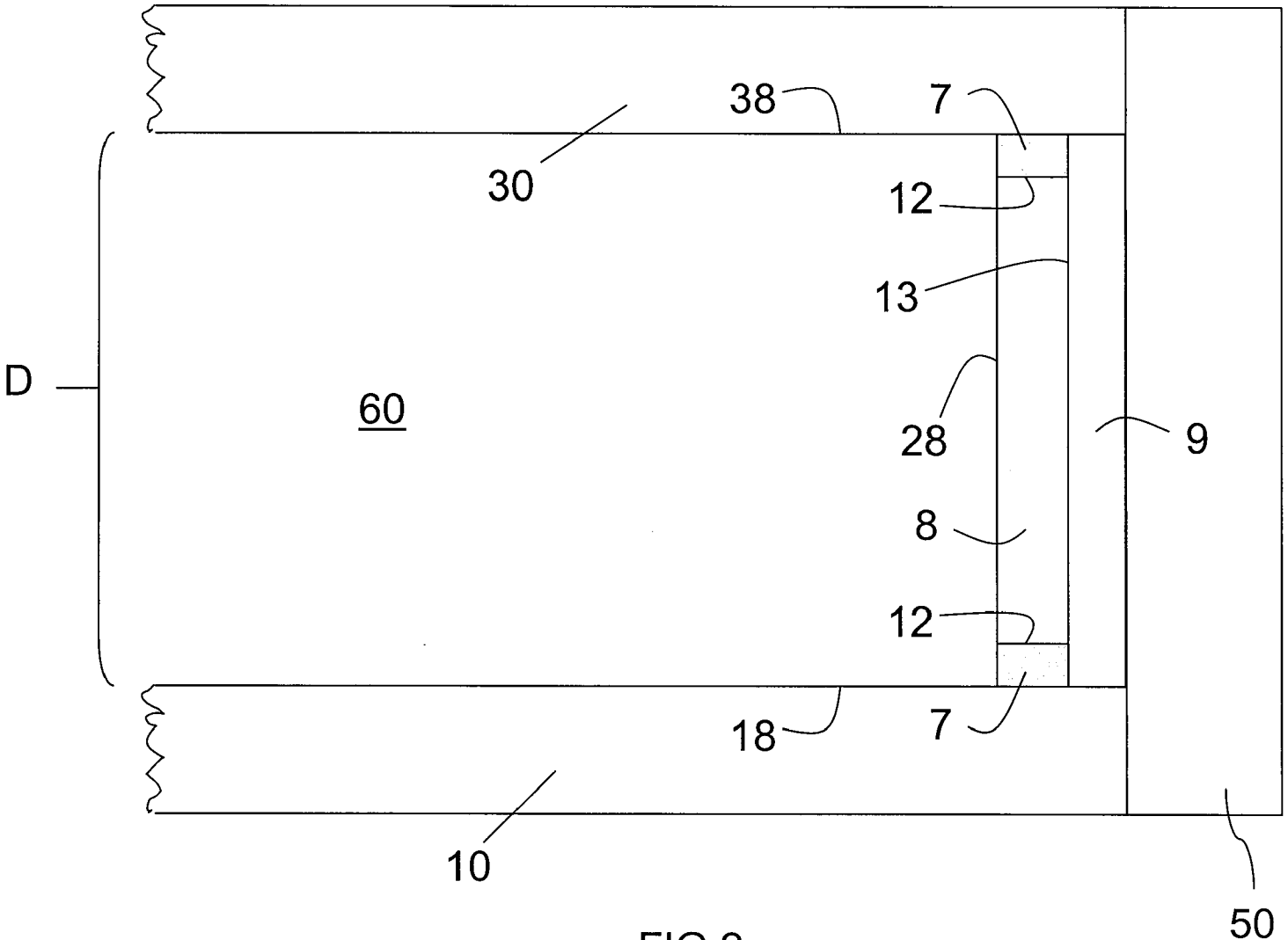
FIG. 2 is a partial cross-sectional view of FIG. 1 taken along plane A-A.
Figure 3:
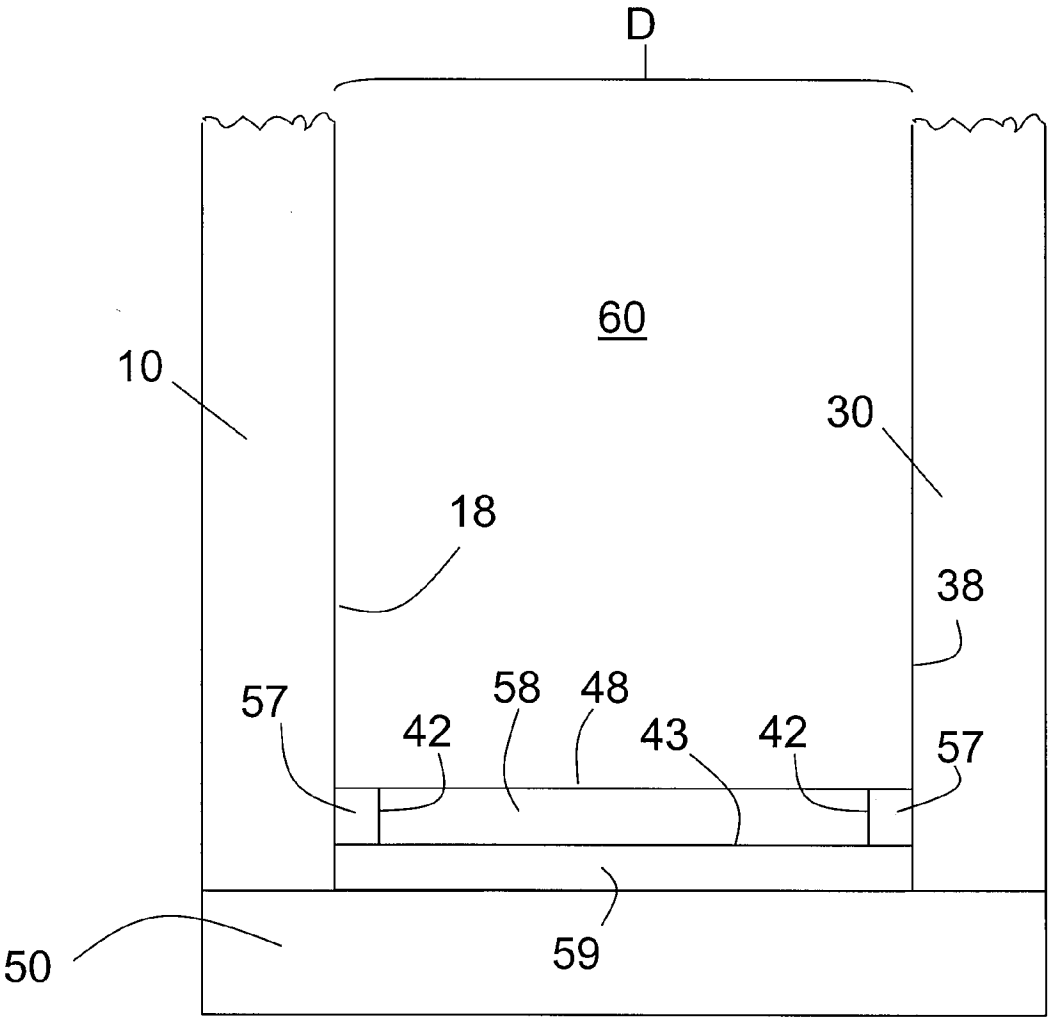
FIG. 3 is a partial cross-sectional view of FIG. 1 taken along plane B-B.

As best illustrated in FIGS. 1-3, a preferred type of enclosure is an insulated glass unit (IG) 2, with optional frame 50, has first and second opposed panes 10, 30 and spacers 8, 58 enclosing an interpane space 60 filled with the filling gas. Panes 10, 30 may be composed of a single sheet of glass or laminated glass such as two sheets of glass sandwiching a thin layer of plastic such as polyvinylbutyral. The panes 10, 30 are spaced from another via spacer 8 and the relative gas-tightness of the IGU 2 is achieved by sealing the space in between long edge 13, 43 of the spacer 8, 58 and frame 50 with a primary sealant 9, 59 and sealing the gap between short edges 12, 42 of the spacer 8, 58 and inner surfaces 18, 38 of panes 10, 30 with a secondary sealant 7, 57. The primary sealant 9 provides mechanical rigidness to the window structure by strongly adhering the spacer 8, 58 to the frame 50 and is typically made of silicone, polyurethane, or any other adhesively bonding material used in the field of insulated glass windows. The secondary sealant 7, 57 is typically a gas-impermeable material that resists permeation of the filling gas therethrough. The insulated glass unit IGU 2 also has a fluid filling hole 20 through which a filling lance 1 may be inserted and a fluid exit hole 40 through which gas from interpane space 60 escapes from the IGU 2 during a filling process. In order to reduce the creation of localized areas of high pressure adjacent the fluid exit hole 40, the IGU 2 may have more than one fluid exit hole 40.

Optionally, the IG 2 may have more than 2 panes 10, 30, such as three or even four sets of opposed panes each adjacent pair of which sandwiches a sealed interpane space 60. In this case, it is understood that each interpane space 60 in between two adjacent panes is separately filled with the filling gas. Also, a vacuum may be applied to fluid exit hole 40 to enhance removal of the gas escaping from interpane space 60.

Preferably, the IGU 2 is oriented such that the lower edge of the pane 10, 30 forms an angle (with respect to horizontal) in a range of from 1-179°, preferably 5-175°, more preferably 15-165°, even more preferably 30-150°, and most preferably around 45°. As seen in further detail below, such an orientation limits the lateral extent of the air head space trapped at the top if the IGU 2 during the filling process. This allows more efficient purging of air from the top of the IGU 2 during the filling process.

Simplest Embodiment for Filling the IGU 2 with the Filing Gas

The IGU 2 may be filled with the filling gas as follows. In the simplest form of the disclosed method and system, an operator enters a dimension (height or width or thickness) of the enclosure to be filled into a Human Machine Interface (HMI) associated with a controller. The controller is written with an algorithm comprising a Decision Support Tool. Alternatively, no controller written with an algorithm is used and the Decision Support Tool is a calibration curve (as explained in greater detail below) alone. If the width is used, a more accurate width corresponds to the distance between the inner edge 28 of spacer 8 on the right side of the IGU 2 and the inner edge of the corresponding spacer on the right side of the IGU 2. However, a width corresponding to the distance between the left-most edge of pane 10, 30 and the right-most edge of pane 10, 30 could also be used. Indeed, even the width corresponding to the distance between the left-most edge of frame 50 and the right-most edge of frame 50 could be used as well. Similarly, if a height is used, a more accurate height corresponds to the distance between the inner edge 48 of spacer 58 and the inner edge of the corresponding spacer on the top of the IGU 2. However, a height corresponding to the distance between the top-most edge of pane 10, 30 and the bottom-most edge of pane 10, 30 could also be used. Indeed, even the height corresponding to the distance between the top-most edge of frame 50 and the bottom-most edge of frame 50 could be used as well. The thickness corresponds to the distance in between panes 10, 30.

Next, the filling lance 1 connected to a source (not shown) of the filling gas is inserted into the fluid filling hole 20 and the fluid exit hole 40 is either unplugged or uncovered. An oxygen analyzer 70 is then placed at a position adjacent fluid exit hole 40. Alternatively, the analyzer 70 may be placed at the exit of, or within, a piece of tubing and the tubing could be connected to a source of vacuum and/or to a device for recovering any of the filling gas exiting the interpane space 60. If this alternative option is selected, the analyzer 70 is typically located no more than 5 feet from the fluid exit hole 40. Preferably, the analyzer 70 is located no more than 3 feet from the fluid exit hole 40, more preferably no more than 1 foot, and even more preferably no more than 3 inches. Alternatively, the analyzer 70 is located inside the fluid exit hole 40 or even a distance within the interpane space 60 from the fluid exit hole 40.

The oxygen analyzer 70 is preferably one with a relatively short response time. For example, a robust oxygen analyzer 70 will have a response time $T_{90}$ of no more than 2 seconds, preferably no more than 0.5 seconds. The skilled artisan will recognize that $T_{90}$ is the duration of time between the moment the analyzer 70 is exposed to the analyte gas of interest and the moment that the analyzer 70 senses an oxygen concentration that is 90% of the ultimate, stable oxygen concentration sensed.

A preferred type of oxygen analyzer 70 is a non-invasive, optical sensor. This type of oxygen analyzer 70 offers the advantage of not restricting the flow rate of the gas exiting fluid exit hole 40 so that it does not require a dedicated vacuum line. The relatively small size of such an oxygen analyzer 70 allows it to be placed adjacent to or inside the fluid exit hole 40 or even well within the interpane space 60. One particularly preferred type of oxygen analyzer 70 is one that is non-invasive and whose detection mechanism is optically based. Preferably, it is based upon fluorescence quenching of a Ruthenium or Platinum complex. One type of an oxygen analyzer 70 that has an optically-based detection mechanism is one that utilizes a light source to irradiate a material (such as a Ruthenium complex) exhibiting a degree of fluorescence that is associated with an oxygen concentration adjacent the material. With such an oxygen analyzer 70, the fluorescing material may even be located anywhere inside the interpane space 60 and the light source is positioned outside the interpane space 60 such that the light source irradiates the material through one of the panes 10, 30.

These particularly preferred types of oxygen analyzer 70 exhibit other advantages. They have an excellent concentration measurement rate of around 5-15 measurements per second which corresponds to a response time of 0.066 to 0.2 seconds. They may be placed in the flow path of the full flow of filling gas escaping the fluid exit hole 40, for example, 20-20 standard liters per minute (slpm). Thus, they do not require a fractional slipstream or bypass to be withdrawn from the main flow of filling gas exiting the fluid exit hole 40. In contrast, conventional thermal conductivity type detectors require such a fractional slipstream. Otherwise, such conventional detectors will be overcooled and will no longer operate within their calibrated range of performance. A suitable, commercially available oxygen analyzer 70 may be obtained from the following sources:

- OpTech™-$0_2$Platinum oxygen analyzer from Mocon, Inc. located in Minneapolis, Minn., USA
- Non-Invasive Oxygen Sensors from Precision Sensing GmbH located in Regensburg, Germany
- Fiber Optic Oxygen Sensor systems from Ocean Optics, Inc. located in Dunedin, Fla., USA
- SensiSpot™ oxygen sensor from Gas Sensor Solutions, Ltd, located in Dublin, Ireland
- Redlight oxygen-sensing probe from Luxcel Biosciences Ltd located in Cork, Ireland
- GEN III 5000 series from Oxy-Sense, Inc. located in Dallas, Tex., USA Next, the operator initiates filling of the IGU 2 with the filling lance 1 with the controller. The controller automatically stops the filling according to a decision made by the Decision Support Tool. The Decision Support Tool selects the filling flow rate and/or the threshold oxygen concentration. In simple embodiments where the Decision Support Tool selects the filling flow rate, filling of the enclosure with the filling gas by the filling lance may be automatically performed at the selected filling flow rate without operator intervention. Alternatively, the filling flow rate selected by the Decision Support Tool may be displayed by the HMI and the operator manually adjusts the filling lance (and associated equipment if any) to the displayed filling flow rate.

Finally, the fluid filling and exit holes 20, 40 are either plugged or covered.

Complex Embodiments

In more complex embodiments and if desired, an algorithm embodying the Decision Support Tool may optionally be modified by the operator according to any permutation of one or more of the following ways.

First, the operator may utilize the HMI to select a particular threshold oxygen concentration (at which filling of the IGU 2 with the filling gas is to be stopped) and the Decision Support Tool will select an optimized filling flow rate to be utilized during filling. Selection of a particular threshold Oxygen concentration is not critical. However, the selected threshold Oxygen concentration should not be so low that it is near the detection limit accuracy of the oxygen analyzer 70. Also, the selected threshold Oxygen concentration should not be so high (i.e., approaching that of air), because then the IGU 2 will not have at the completion of filling a sufficiently high concentration of the filling gas. Preferably, the selected threshold Oxygen concentration is no less than 5% and no greater than 18%. Alternatively, the controller may already have a threshold oxygen concentration pre-selected or the algorithm (embodying the Decision Support Tool) on the controller may be adapted to determine an optimized threshold oxygen concentration.

Second, the operator may utilize the HMI to select a particular filling flow rate to be inputted to the controller and the Decision Support Tool will select an optimized oxygen threshold concentration (at which filling of the IGU 2 with the filling gas is to be stopped). Selection of a particular filling rate is also not critical. However, the selected filling rate should not be so low that filling takes an unreasonably long duration time. Also, the selected filling rate should not be so high that safety risks are created. Alternatively, the controller may already have a filling flow rate pre-selected or the algorithm (embodying the Decision Support Tool) on the controller may be adapted to determine an optimized filling flow rate.

These first two options may be desirable when the operator's experience indicates that a particular threshold oxygen concentration or flow rate setting works particularly well. These more complex embodiments may be contrasted with the simplest embodiment where an algorithm (which embodies the Decision Support Tool) of the controller selects an optimized threshold Oxygen concentration and flow rate and the operator need not select either.

Third, the operator may utilize the HMI to select a minimum or maximum value for one or two filling parameters upon which the filling rate and/or the sensed threshold Oxygen concentration is further optimized. These filling parameters include a minimum concentration of the filling gas inside interpane space 60 at the completion of filling, a maximum percent loss of the filling gas realized during the filling process, or a maximum filling duration. Thus, the Decision Support Tool will select either a threshold oxygen concentration or a filling flow rate that corresponds to potential results that are above the minimum value for the filling parameter(s) at issue and/or below the selected maximum value of the filling parameter(s) at issue. Alternatively, the controller may already have one of these filling parameter minimum or maximum values pre-determined and the operator need not select one, or the calibration curve of the Decision Support Tool already has the minimum or maximum value incorporated thereinto.

Fourth, the operator may also utilize the HMI to select a filling parameter (other than the threshold oxygen concentration or filling flow rate) that is to be optimized. These filling parameters include the concentration of the filling gas inside interpane space 60 at the completion of filling, the percent loss of the filling gas realized during the filling process, or the filling duration. Thus, the Decision Support Tool will select either a threshold oxygen concentration or a filling flow rate that corresponds to potential results that are associated with the predicted highest concentration of the filling gas inside interpane space 60 at the completion of filling and/or the predicted lowest percent loss of the filling gas realized during the filling process and/or the predicted shortest filling duration. Alternatively, the controller may already have one of more or all of these filling parameters pre-selected and the operator need not select one, or the calibration curve of the Decision Support Tool already has the additional filling parameter incorporated thereinto.

While the development of the Decision Support Tool below will be described in detail below, for purposes of clarity it should be noted that, in the simplest embodiment, options three and four have already been incorporated into the Decision Support Tool.

Regardless of whether the simplest embodiment or a more complex embodiment is elected, what they all have in common is that the algorithm (embodying the Decision Support Tool) written to the controller will select a threshold oxygen concentration and/or a filling flow rate based upon one or dimensions of the enclosure to be filled. Or, in the case of a calibration curve comprising the Decision Support Tool, the calibration curve may be used to select a threshold oxygen concentration and/or a filling flow rate and the curve(s) are based upon one or more dimensions of the enclosure to be filled.

Next, the operator initiates filling of the IGU 2 with the filling gas. For embodiments where an algorithm embodies the Decision Support Tool, the controller automatically stops the filling when the measured Oxygen concentration of the filling gas exiting the fluid exit hole 40 reaches the threshold Oxygen concentration. It should be recognized that the threshold Oxygen concentration may have been previously inputted to the controller, or the operator inputs the threshold Oxygen concentration to the controller via the HMI, or the threshold Oxygen concentration is selected by the Decision Support Tool. For embodiments where a calibration curve embodies the Decision Support Tool, it should be noted that, before filling has commenced, the operator has previously consulted the calibration curve and performed one of the following options:

A) the operator looks up a threshold Oxygen concentration (when a particular filling flow rate is already incorporated into the calibration curve) on the calibration curve that corresponds to the filling rate at which the filling is to be performed, where the calibration curve is based upon the minor dimension of the enclosure to be filled; OR B) the operator looks up a filling flow rate (when a particular threshold Oxygen concentration is already incorporated into the calibration curve) on the calibration curve that corresponds to threshold Oxygen concentration at which the filling is to be stopped, wherein the calibration curve is based upon the minor dimension of the enclosure to be filled.

Vacuum Embodiment

In a manufacturing/industrial context, if the overall production rate for the filling of a series of the IGU 2 in a filling line in a factory is of relatively great concern, it may be desirable to increase the filling rate beyond a rate which is optimized and/or which may present a safety risk.

A pressure buildup may occur in the IGU 2 because the fluid exit hole 40 is a restriction. When the flow rate of filling gas through the IGU 2 is relatively low, such as <20 slpm for a fluid exit hole 40 diameter of 3.5 mm, the hole 40 presents a minimal restriction. When the flow rate is relatively high, the exit 40 creates a large pressure drop and thus a pressure buildup within the IGU 2 that will depend upon the flow rate and the diameter of the exit hole 40.

There are two ways to avoid pressure buildup within the IGU 2 during filling: 1) selection of a large diameter for the exit hole 40; and 2) applying a vacuum to the exit hole 40. Thus, in order to increase the rate at which the IGU 2 is filled with the filling gas, in another embodiment, a vacuum ("the vacuum embodiment") may be applied to the fluid exit hole 40 during the filling of the IGU 2. Any source of vacuum may be utilized, but the simplest solution is to use a vacuum pump.

The vacuum embodiment is performed in the same way as discussed above, except that the flow rate setting for the filling lance 1 will need to be adjusted downward in order to compensate for the increase in actual flow rate of the filling gas through the enclosure that is produced by application of a vacuum to the fluid exit hole 40. The skilled artisan may do this through routine and simple experimentation to establish the relationship between the degree of vacuum applied to the fluid exit hole 40, the flow rate selected at the filling lance 1, and the actual flow rate of the filling gas through the IGU 2. More particularly, the skilled artisan may vary the degree of vacuum applied and record the actual flow rates (using a flow meter) produced by the degrees of applied vacuum. Alternatively, a controller may be utilized to capture data comprising signals (such as voltage) from the pump that are associated with the level of vacuum and signals from a flow meter that are associated with the actual flow rate. The captured data then can be incorporated into the algorithm of the HMI to automatically apply a correction factor to the selected flow rate of the filling lance 1 (or the algorithm-determined or calibration curve-determined flow rate for the filling lance 1) in order to compensate for the particular level of vacuum applied.

Decision Support Tool

The development of the Decision Support Tool will now be described.

The Decision Support Tool is based upon data compiled from the filling of a plurality of test enclosures according to permutations of various filling parameters. It may take form as an algorithm written to a controller or as a calibration curve. Practically speaking, a filling process is described by two parameters: the flow rate of filling and the concentration of the gas of interest (or conversely, the Oxygen content) of the gas stream leaving the enclosure. To optimally fill the enclosure is thus to find an optimum couple of flow rate and threshold Oxygen concentration. The optimum flow rate or threshold Oxygen concentration depends upon the size of the enclosure, whether that size is expressed in terms of a volume (height, width, and thickness) cross-sectional surface area (height and width, height and thickness, or width and thickness) or in terms of a single dimension (height or width or thickness) of the enclosure to be filled.

While the test enclosures have sizes different than that of the enclosure to be filled, it should be understood that the test enclosures should have a same dimension (typically thickness) as that of the enclosure to be filled. In the case of an IGU 2, the dimension can be the interpane spacing D.

Ideally, the test enclosures will have a same cross-sectional shape as that of the enclosure to be filled. In the case of a triangular prism-shaped enclosure to be filled, the test enclosures will ideally have the same angles at the corners of the triangular cross-section. Nevertheless, in the case of a right rectangular prism-shaped enclosure to be filled, the test enclosure may have a different cross-sectional shape than that of the enclosure to be filled. For example, while the right rectangular prism-shaped enclosure to be filled may have a rectangular cross-section, the test enclosures may have a square cross-section (i.e., a height to width ratio of 1:1) or vice versa.

Thus, in the case of determining an optimal filling of a right rectangular prism-shaped enclosure having non-equal width and height, ideally the ratio of height to width of each of the test enclosures (also having a right rectangular prism shape) should ideally be the same as that of the enclosure to be filled. However, for the sake of simplicity and as an approximation, right rectangular prism-shaped test enclosures having a square cross-section can be used to develop the Decision Support Tool. Thus, it reduces to one the number of dimensions of the enclosure to be filled that must be inputted into the Decision Support Tool (either width or height). This choice (reduction to one dimension) is meaningful since maximum gas loss will occur with enclosures having a square cross-section. In other words, it is more difficult to limit the gas loss for square cross-section enclosures than for rectangular cross-section enclosures so that a Decision Support Tool developed for square cross-section test enclosures will work for any kind of rectangular cross-section enclosures to be filled.

As discussed above, at least two different sizes of square cross-section test enclosures should be utilized in developing the Decision Support Tool. Preferably, three or more sizes of square cross-section enclosures should be utilized. The sizes of the square cross-section enclosures used to develop the Decision Support Tool (from smallest to largest) should be selected such that the sizes of the enclosures to be filled using the Decision Support Tool will fall between the sizes of the smallest and largest of the square cross-section test enclosures. In other words, the surface area (the multiplication product of width X height) of the enclosures should be larger than the smallest test enclosure and smaller than the largest test enclosure. In order to have a relatively greater degree of optimization when a wide variety of sizes of enclosures are to be filled using the Decision Support Tool, it is recommended to develop it using a wide variety of square cross-section test enclosures.

After the number and sizes of the test enclosures are determined, the operator selects a series of threshold $O_2$ concentrations (to be sensed by the Oxygen analyzer 70) for use as constraints in compiling the data (associated with the filling of the plurality of test enclosures) necessary for the Decision Support Tool. These correspond to the $O_2$ concentrations of the gas exiting the test enclosures. When the Oxygen analyzer senses a selected $O_2$ threshold concentration, filling of the test enclosures with the filling gas is stopped and various filling parameters are recorded, such as duration of filling, filling gas loss, and concentration of filling gas within the filled test enclosure. The selected threshold $O_2$ levels should not too close to the concentration of Oxygen in air (about 21%), because in that case the Oxygen analyzer will sense the threshold level and stop the filling before any substantial filling is completed. The $O_2$ threshold values should also not be so low (such as a fraction of a percent), because in that case the test enclosure continues to be filled with the filling gas for an unreasonably long period of time. A very low $O_2$ threshold value is also of limited use because the only purpose it would serve would be for accomplishing filling of the enclosure with a needlessly high purity of the filling gas after completion of filling. Simple and routine experimentation may be performed to determine whether the selected threshold levels are either too high (too close to that of air and prematurely cuts off filling) or too low (too long a filling duration). While at least two $O_2$ threshold concentrations should be selected, a greater number of $O_2$ threshold concentrations will result in a relatively greater degree of optimization achieved by the Decision Support Tool.

Next, a series of incrementally increasing filling flow rates are selected for use as constraints in compiling the data (associated with the filling of the plurality of test enclosures) necessary for the Decision Support Tool. The lowest filling flow rate should not be so low that the filling duration is unduly long. It should also not be so high because very high filling rates will waste gas. Again, simple and routine experimentation may be undertaken to determine appropriately low or high filling flow rates. While at least two filling flow rates should be selected, a greater number of filling flow rates will result in a relatively greater degree of optimization achieved by the Decision Support Tool.

Next, the test enclosures (initially filled with air) are filled at the first selected filling flow rate until the Oxygen analyzer senses the first selected $O_2$ threshold level and the filling duration (time), percent gas loss, and final filling gas concentration are recorded. The percent gas loss may be calculated in many ways and preferably according to the following formula:

Gas loss is defined as follows:

$$\text{Gas Loss}(\%) = \frac{\frac{Q \times t}{60} - C_{IG} \times V_{IG}}{C_{IG} \times V_{IG}} \times 100$$

Where

Q is the flow rate of filling (slpm or standard liter per minute)

t is the filling duration (second)

$C_{IG}$ is the gas content within the insulated glass once the filling is stopped (% per volume)

$V_{IG}$ is the interpane volume (liter)

In other words, $$\frac{Q \times t}{60}$$

represents the total volume of gas used during the filling process and $C_{IG} \times V_{IG}$ represents the volume of gas within the interpane.

Thus, the gas loss is defined as the volume of fill gas vented outside the interpane with respect to the volume of fill gas presents within the interpane.

The filling gas is then vented from the test enclosure and the test enclosure is filled at the first selected filling flow rate until the second selected $O_2$ threshold concentration is sensed by Oxygen analyzer. This process is repeated with the third (if more than two are chosen) and other selected $O_2$ threshold levels. The above series of fillings is then repeated for the second and third (if more than two are chosen) and other selected filling flow rates. So, if 4 filling flow rates and 3 $O_2$ threshold levels are selected, each test enclosure is filled with the filling gas twelve times.

Once the data have been compiled, the Decision Support Tool is crated by filtering the data. This may be done in several different ways.

In a first way of filtering the data, a first artificial constraint of either threshold Oxygen concentration or flow rate is applied to the data associated with each test enclosure so that the remaining data all are either associated with a particular threshold Oxygen concentration or a particular flow rate. Out of the remaining data (for each test enclosure) after application of the first artificial constraint, a second artificial constraint is applied that filters out some data as undesirable. A third artificial constraint is then applied to the data remaining after the second filter (for each test enclosure) to yield one data point per test enclosure that corresponds to the most desirable value of the third artificial constraint. If the first artificial constraint is threshold Oxygen concentration, then the final remaining data point is in terms of flow rate. If the first artificial constraint is flow rate, then the final remaining data point is in terms of threshold Oxygen concentration. The second or third artificial constraint can be the filling duration, the filling gas loss, or the final filling gas concentration.

Because there are three different choices for each of the second and third artificial constraints, one of ordinary skill in the art will recognize that an optimal filling flow rate may be determined in a variety of ways.

a) The operator may decide that only filling durations of a certain time or less are desirable and the data are screened to eliminate all test enclosure fillings that are associated with an undesirably high filling duration. The operator then decides that loss of the filling gas is an important parameter and the remaining data are reviewed to see which data couple of flow rate and $O_2$ threshold concentration yields the lowest filling gas loss. Out of this regime, the remaining data point (of either threshold Oxygen concentration or flow rate) is then selected for each of the test enclosures.

b) The operator may decide that only filling durations of a certain time or less are desirable and the data are screened to eliminate all test enclosure fillings that are associated with an undesirably high filling duration. The operator then decides that ensuring a final filling gas concentration of high purity is an important parameter and the remaining data are reviewed to see which data couple of flow rate and $O_2$ threshold concentration yields the highest final filling gas concentration. Out of this regime, the remaining data point (of either threshold Oxygen concentration or flow rate) is then selected for each of the test enclosures.

c) The operator may decide that only filling gas losses of a certain level or less are desirable and the data are screened to eliminate all test enclosure fillings associated with an undesirably high filling gas loss. The operator then decides that filling duration is an important parameter and the remaining data are reviewed to see which data couple of flow rate and $O_2$ threshold concentration yields the shortest filling duration. Out of this regime, the remaining data point (of either threshold Oxygen concentration or flow rate) is then selected for each of the test enclosures.

d) The operator may decide that only filling gas losses of a certain level or less are desirable and the data are screened to eliminate all test enclosure fillings associated with an undesirably high filling gas loss. The operator then decides that ensuring a final filling gas concentration of high purity is an important parameter and the remaining data are reviewed to see which data couple of flow rate and $O_2$ threshold concentration yields the highest final filling gas concentration. Out of this regime, the remaining data point (of either threshold Oxygen concentration or flow rate) is then selected for each of the test enclosures.

e) The operator may decide that only final filling gas concentrations of a certain purity or higher are desirable and the data are screened to eliminate all test enclosure fillings associated with undesirably low final filling gas concentrations. The operator then decides that filling duration is an important parameter and the remaining data are reviewed to see which data couple of flow rate and $O_2$ threshold concentration yields the shortest filling duration. Out of this regime, the remaining data point (of either threshold Oxygen concentration or flow rate) is then selected for each of the test enclosures.

f) The operator may decide that only final filling gas concentrations of a certain purity or higher are desirable and the data are screened to eliminate all test enclosure fillings associated with undesirably low final filling gas concentrations. The operator then decides that loss of the filling gas is an important parameter and the remaining data are reviewed to see which data couple of flow rate and $O_2$ threshold concentration yields the lowest filling gas loss. Out of this regime, the remaining data point (of either threshold Oxygen concentration or flow rate) is then selected for each of the test enclosures.

Continuing in the explanation of the first way of filtering the data, in the case of an algorithm embodying the Decision Support Tool, the algorithm is written an equations, corresponds to either: A) a line fitted to a plot of flow rate versus test enclosure dimension (corresponding to the selected data points remaining after application of the first artificial constraint of threshold Oxygen concentration and after application of and the second and third artificial constraints); or B) a line fitted to a plot of threshold Oxygen concentration versus test enclosure dimension (corresponding to the selected data points remaining after application of the first artificial constraint of flow rate and after application of the second and third artificial constraints). Hence:

$$\text{flow rate}=ax+b$$

$$\text{threshold Oxygen concentration}=cx+d$$

wherein x is the dimension of the enclosure to be filled. The algorithm then selects a flow rate according to the equation (when the first artificial constraint is threshold Oxygen concentration) or a threshold Oxygen concentration (when the first artificial constraint is flow rate) and filling is performed according to the selected flow rate or the selected threshold Oxygen concentration. The dimension of the enclosure to be filled should be the same dimension as that of the test enclosures used to create the equation. In other words, if the equations utilize the width of the test enclosures in creating the equations (corresponding to lines plotted in a graph of flow rate versus dimension of the test enclosure and threshold Oxygen level versus dimension of the test enclosure), x in the above equations will be the width of the enclosure to be filled. However, in should be noted that, in the case of square cross-section test enclosures and a rectangular cross-section enclosure to be filled, x is more desirably either the square root of the multiplication product of two dimensions of the enclosure to be filled or the cube root of the multiplication product of three dimensions of the enclosure to be filled. In other words, x is more desirably either:

the square root of width X height (of the enclosure to be filled);

the square root of width X thickness (of the enclosure to be filled);

the square root of height X thickness (of the enclosure to be filled); or the cube root of width X height X thickness (of the enclosure to be filled).

In the case of a Decision Support Tool embodied by a calibration curve, a calibration curve is plotted of flow rate vs. dimension of the test enclosure (when threshold Oxygen concentration is the first artificial constraint), or of threshold Oxygen concentration vs. dimension of the test enclosure (when flow rate is the first artificial constraint). The term "calibration curve" is of course generic to both curves and lines in that statistical analysis can be applied to the data points to yield either a line or a curve using commercially available software or well-known statistical methods. Thus, the calibration curve may actually be plotted on paper or may be an electronic derivation of data corresponding to what would manually be performed as a plot of a calibration curve. During the filling process, the operator may look up a flow rate of threshold Oxygen concentration on the curve corresponding to the dimension of the enclosure to be filled. The dimension of the enclosure to be filled should be the same dimension as that of the test enclosures used to create the calibration curve. In other words, if the calibration curve utilizes the width of the test enclosures, x in the above equations will be the width of the enclosure to be filled. However, in should be noted that, in the case of square cross-section test enclosures and a rectangular cross-section enclosure to be filled, x is more desirably either the square root of the multiplication product of two dimensions of the enclosure to be filled or the cube root of the multiplication product of three dimensions of the enclosure to be filled. In other words, x is more desirably either:

- the square root of width X height (of the enclosure to be filled);
- the square root of width X thickness (of the enclosure to be filled);
- the square root of height X thickness (of the enclosure to be filled); or
- the cube root of width X height X thickness (of the enclosure to be filled).

In a second and preferred way of filtering the data, first and second artificial constraints are applied that filters out some data (for each test enclosure) as undesirable. The first and second artificial constraints include values for any pair of the following filling parameters:

a) gas losses at or below a maximum value and final filling concentrations at or above a minimum value;
b) gas losses at or below a maximum value and a filling duration at or below a maximum value;
c) final filling concentrations at or above a minimum value and a filling duration at or below a maximum value.

Out of the remaining data after application of the first and second artificial constraints (for each test enclosure), a third artificial constraint is then applied to yield one data point per test enclosure that corresponds to the most desirable value of the third artificial constraint. Thus, if the third artificial constraint is gas loss, the data point yielded for each test enclosure is the data point that corresponds to the lowest gas loss out of the data remaining after application of the first and second artificial constraints. Similarly, if the third artificial constraint is final filling concentration, the data point yielded for each test enclosure is the data point that corresponds to the highest final filling concentration out of the data remaining after application of the first and second artificial constraints. Finally, if the third artificial constraint is filling duration, the data point yielded for each test enclosure is the data point that corresponds to the shortest filling duration out of the data remaining after application of the first and second artificial constraints.

Continuing the description of the second way of filtering the data, one of ordinary skill in the art will recognize that there are many permutations of carrying out the second way of filtering data:

a) Only gas losses of a certain maximum value or less are desirable and the data (for each test enclosure) are screened to eliminate all test enclosure fillings that are associated with an undesirably high gas loss. Only final filling concentrations of a certain purity or higher are desirable and the data (for each test enclosure) are screened to eliminate all test enclosure fillings that are associated with an undesirably low final filling concentration. Filling duration is an important parameter and the remaining data (for each test enclosure and after application of the first and second data constraints of gas loss and final filling concentration) are reviewed to see which data couple of flow rate and $O_2$ threshold concentration yields the shortest filling duration. The data point for each test enclosure is then selected. OR
b) Only gas losses of a certain maximum value or less are desirable and the data (for each test enclosure) are screened to eliminate all test enclosure fillings that are associated with an undesirably high gas loss. Only filling durations of a certain time or lower are desirable and the data (for each test enclosure) are screened to eliminate all test enclosure fillings that are associated with an undesirably high filling duration. Final filling concentration is an important parameter and the remaining data (for each test enclosure and after application of the first and second data constraints of gas loss and filling duration) are reviewed to see which data couple of flow rate and $O_2$ threshold concentration yields the highest final filling concentration. The data point for each test enclosure is then selected. OR
c) Only final filling concentrations of a certain purity or higher are desirable and the data (for each test enclosure) are screened to eliminate all test enclosure fillings that are associated with an undesirably low final filling concentration. Only filling durations of a certain maximum value or less are desirable and the data (for each test enclosure) are screened to eliminate all test enclosure fillings that are associated with an undesirably long filling duration. Gas loss is an important parameter and the remaining data (for each test enclosure and after application of the first and second data constraints of final filling concentration and filling duration) are reviewed to see which data couple of flow rate and $O_2$ threshold concentration yields the lowest gas loss. The data point for each test enclosure is then selected.

Continuing in the explanation of the second way of filtering the data, the algorithm is written with two equations, each of which corresponds to a line fitted to a plot of flow rate versus test enclosure dimension (corresponding to the selected data points) or a line fitted to a plot of threshold Oxygen concentration versus test enclosure dimension (corresponding to the selected data points). Hence:

$$\text{flow rate}=ax+b$$

$$\text{threshold Oxygen concentration}=cx+d$$

wherein x is the dimension of the enclosure to be filled. The dimension of the enclosure to be filled should be the same dimension as that of the test enclosures used to create the equation. In other words, if the equations utilize the width of the test enclosures in creating the equations (corresponding to lines plotted in a graph of flow rate versus dimension of the test enclosure and threshold Oxygen level versus dimension of the test enclosure), x in the above equations will be the width of the enclosure to be filled. However, in should be noted that, in the case of square cross-section test enclosures and a rectangular cross-section enclosure to be filled, x is more desirably either the square root of the multiplication product of two dimensions of the enclosure to be filled or the cube root of the multiplication product of three dimensions of the enclosure to be filled. In other words, x is more desirably either:

- the square root of width X height (of the enclosure to be filled);
- the square root of width X thickness (of the enclosure to be filled);
- the square root of height X thickness (of the enclosure to be filled); or
- the cube root of width X height X thickness (of the enclosure to be filled).

During the filling process, the algorithm then selects the flow rate and the threshold Oxygen concentration (at which the filling process is to be performed) from the above equations.

The disclosed method and system yield several advantages over conventional methods and systems. As described in greater detail in Example 1, a slow and far distant gas sensor (i.e. placed far away from the outlet port) can result in a several second delay. Depending on the flow rate of filling, this delay can lead to the loss of several liters of expensive fill gas. On the other hand, the invention utilizes a fast and non-bulky sensor that may be placed adjacent to or inside the fluid exit hole 40 or even well within the interpane space 60 which results in very short delays. In the case of an optical sensor utilizing a light source to irradiate a material exhibiting a degree of fluorescence associated with an oxygen concentration adjacent the material, the fluorescing material may even be located anywhere inside the interpane space 60 and the light source is positioned outside the interpane space 60 such that it irradiates the material through one of the panes 10, 30.

While many conventional filling methods utilize a single flow rate regardless of the size of the IGU being filled, the disclosed method and system include the use of a Decision Support Tool which can determine a filling rate which maximizes the gas content in the IGU 2, optimizes the filling duration, and/or optimizes the retention of the filling gas (decreases the loss of the filling gas in an optimal manner). Therefore, the disclosed filling system adapts the filling flow rate based upon the IGU 2 dimension(s). Finally, the disclosed method and system also have the advantages of being versatile, simple, cost effective, and easy to maintain.

Advantages and/or aspects of the invention will now be described in greater detail in the several Examples.

EXAMPLE 1

Example 1 illustrates the importance of the outlet gas sensor response time in limiting the gas loss when filling a two-paned IGU.

Conditions

Figure 4:
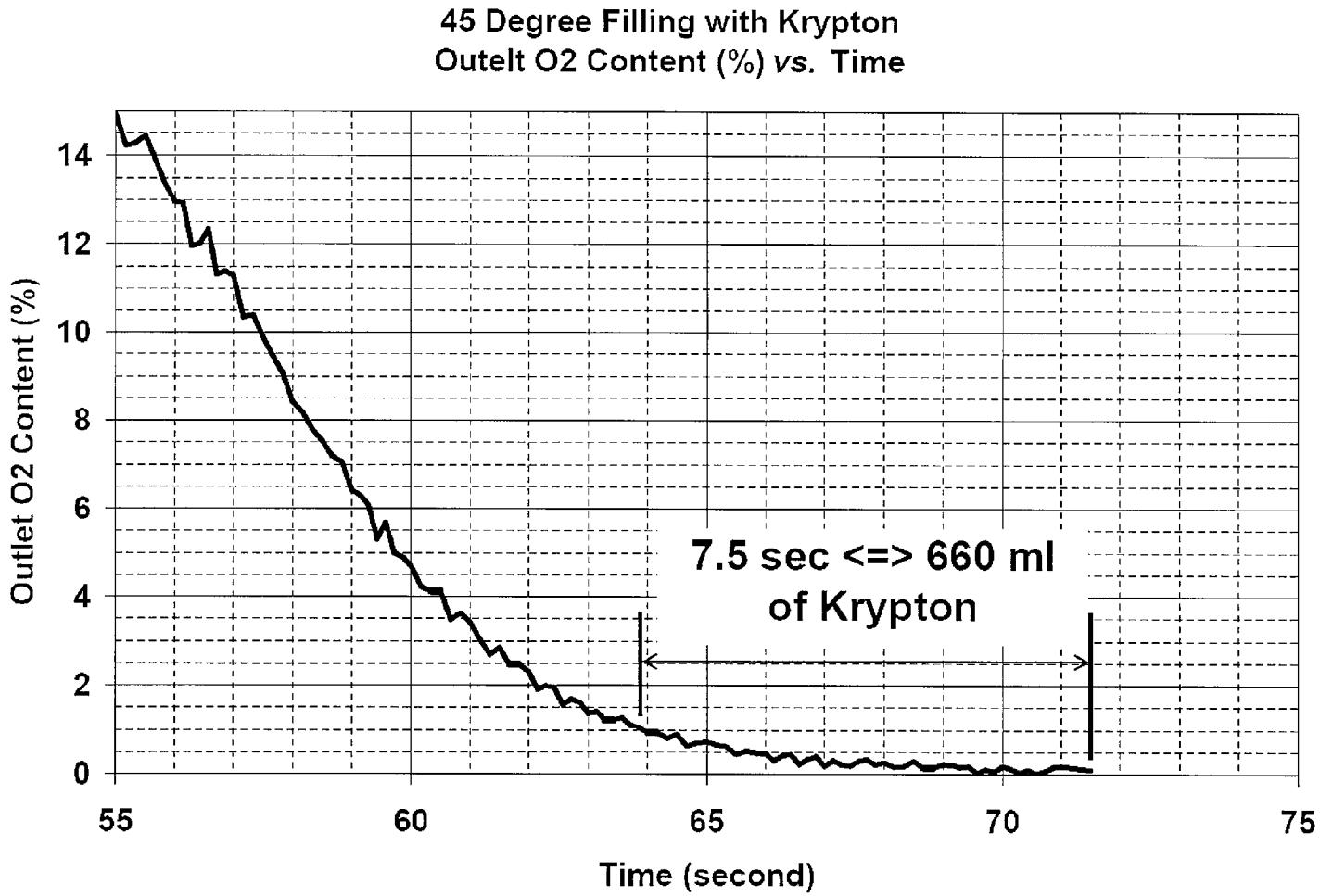
FIG. 4 is a graph showing the impact of the sensor response time on gas loss.

- Rectangular interpane dimensions of 22"×36"×⅜" (i.e. 55.9 cm×91.4 cm×9.5 mm=>0.51 $m^2$ and 4.9 Liter)
- Two-holes filling with Kr
- Insulating glass oriented at 45° during the filling process so that one corner having a hole for filling (or evacuating) is disposed at a bottom of the IGU while an opposite corner having a hole for filling (or evacuating) is disposed at a top of the IGU
- No vacuum applied on the outlet gas stream port
- Flow rate of filling set at 5.4 slpm
- Filling process stopped once thermal sensor detects 95% Kr per volume (condition equivalent to 1% $O_2$)
- $O_2$ content at the exit monitored by very-short response time sensor (see FIG. 4)
- Very-short response time sensor placed at 9" from outlet.

Results

- Using a traditional thermal sensor at the outlet (set at 95% Kr equivalent to 1% $O_2$), the filling process is stopped after 71.5 sec.
- The very-short response time sensor detected the end of the filling process (i.e. 95% Kr at outlet) around 64 seconds, which represents a difference of 7.5 seconds with respect to the thermal sensor.
- Using a very-short response time sensor, the filling duration is decreased by 10.5%, from 71.5 to 64 seconds.
- Furthermore, in this particular case, the use of a very-short response time sensor enables to save 660 ml of krypton.

EXAMPLE 2

Example 2 illustrates the improvement that brings a 45° filling in combination with a short response time sensor vs. a vertical filling in terms of gas content within the interpane for a given filling duration. The 45° filling configuration (see FIG. 5) enables to minimize the air head space before the fill gas start to vent outside the unit. Therefore, for a given filling duration, the gas content is always higher in the case of a 45° filling than the one resulting from a traditional vertical filling. One of ordinary skill in the art will recognize that this particular aspect of the invention is not limited to an angle of 45°. Rather, any angle from 15-75° is still believed to achieve the goal of the non-90° filling angle.

Conditions

- Rectangular interpane dimensions of 22"×36"×⅜" (i.e. 55.9 cm×91.4 cm×9.5 mm=>0.51 $m^2$ and 4.9 Liter)
- Flow rate of filling=10 slpm
- Krypton filling
- Two-holes filling
- No vacuum applied on the outlet gas stream port
- Very-short response time oxygen sensor placed at 9" from outlet.
- Two experiments: (i) vertical Krypton filling and (ii) 45° filling
- Filling process stopped at 33 seconds Results

- At constant filling duration (e.g. 33 sec) and same flow rate of filling, the 45° filling enables to increase the gas content of the interpane while decreasing the gas loss

TABLE 1

Impact of interpane orientation during filling process

| Filling Configuration | Vertical | 45 Degrees |
|---|---|---|
| Outlet O2 Content | 15% | 10% |
| Filling Duration (sec) | 33 | 33 |
| Gas Loss | 18.0% | 13.8% |
| Gas Fill | 95.8% | 99.3% |

Interpane dimension = 22" × 36" × ⅜"
Flow rate of filling = 10 slpm

Gas loss is defined as follows:

$$\text{Gas Loss}(\%) = \frac{\frac{Q \times t}{60} - C_{IG} \times V_{IG}}{C_{IG} \times V_{IG}} \times 100$$

Where

Q is the flow rate of filling (slpm or standard liter per minute)

t is the filling duration (second)

$C_{IG}$ is the gas content within the insulated glass once the filling is stopped % per volume)

$V_{IG}$ is the interpane volume (liter)

In other words, $$\frac{Q \times t}{60}$$

represents the total volume of gas used during the filling process and $C_{IG} \times V_{IG}$ represents the volume of gas within the interpane Thus, the gas loss is defined as the volume of fill gas vented outside the interpane with respect to the volume of fill gas presents within the interpane.

EXAMPLE 3

Example 3 illustrates the improvement in terms of filling duration and gas loss for a given gas content that is produced by a 45° filling vs. a vertical filling.

Conditions

Rectangular interpane dimensions of 22"×36"×⅜" (i.e. 55.9 cm×91.4 cm×9.5 mm=>0.51 $m^2$ and 4.9 Liter)

Flow rate of filling=10 slpm

Krypton filling

Very-short response time oxygen sensor placed at 9" from outlet.

Two-holes filling

No vacuum applied at the outlet gas stream port

Two configurations were considered: vertical filling & 45° filling.

For the vertical filling configuration, 2 fillings were carried out. One was stopped at 41 sec, while the other one was stopped at 48 sec. For each filling, the average interpane gas content was measured and gas loss was derived from it. For the 45° filling configuration, 3 fillings were carried out and respectively stopped at 31, 33 and 37 sec. For each filling, the average interpane gas content was measured and gas loss was derived from it.

Results (see FIG. 6)

Results are compared at 98% krypton fill

The 45 degree filling configuration decreased the filling duration by 30% (from 45.2 sec to 31 sec) and the gas loss by 85% (from 58% to 8.4%) compared to a vertical filling.

EXAMPLE 4

Example 4 illustrates the need for a short response time sensor to maximize the effect of oriented filling (e.g. 45° filling) by comparing the outcomes of both vertical and 45° filling in combination with a long response time thermal sensor.

Conditions

Rectangular interpane dimensions of 22"×36"×⅜" (i.e. 55.9 cm×91.4 cm×9.5 mm=>0.51 $m^2$ and 4.9 Liter)

Flow rate of filling=5.5-5.6 slpm

Krypton filling

Thermal sensor (calibrated for krypton) placed at 10 feet from outlet.

Two configurations are considered: vertical filling & 45° filling.

Two holes filling process

Ending filling criterion: 95% Kr at the outlet gas stream

Results

The two configurations lead to similar filling durations and gas losses. In this case, the response time of the thermal sensor is the limited factor and overcome the benefits brought by the window orientation (see Table)

TABLE 2

Comparison of vertical and oriented filling when performed in combination with a slow response time thermal sensor.

| | Krypton Filling | | |
|---|---|---|---|
| | Flow rate of filling (slpm) | Filling duration (sec) | Gas loss |
| Vertical filling | 5.6 | 73.5 | 40.9% |
| 45° filling | 5.5 | 72.8 | 37.3% |

EXAMPLE 5

Methodology and examples: The sizes of the square IGUs used to develop the Decision Support Tool of Example 5 are as follows: small (14"×14"×⅜"), medium (21"×21"×⅜"), and large (32"×32"×⅜"). This selection of sizes are then appropriate for using the model to fill IGUs having an area (width×height) in the range of 196 to 1,024 square inches. The filling lance OD is 3.5 mm.

Next, a series of threshold $O_2$ levels sensed by the optical sensor is determined: 5%, 10%, 15%, and 18%, all $O_2$ v/v.

Next, a series of incrementally increasing filling flow rates are selected: 2, 4, 6, 8, 10, 12, 14, and 16, all in slpm (slpm is standard liters per minute or a flow rate corresponding to, per minute, a volume of gas corresponding to a liter of gas at temperature of 0° C. and a pressure of 1 atmosphere).

Next, the first square IGU is filled at the first selected filling flow rate until the sensor senses the first selected $O_2$ threshold level. This process is repeated separately using the first selected filling flow rate until the sensor senses the second, third, fourth, and other selected $O_2$ threshold levels. These series of fillings are then repeated for the second, third, fourth, and other selected filling flow rates. In each filling, the filling duration, the gas loss, and the interpane gas concentration are measured and recorded and tabulated (see Tables 3). Each of the other square IGUs is then filled according to the selected $O_2$ threshold levels and filling flow rates as described above. The data are found in Tables 4-6.

TABLE 4

Filling of small IGU

| | | | | |
|---|---|---|---|---|
| | 2 slpm | | | |
| Outlet $O_2$ | 18% | 15% | 10% | 5% |
| Filling duration | 35.7 | 38.7 | 41.1 | 42.4 |
| Gas loss | 6.2% | 12.6% | 17.0% | 18.6% |
| Gas fill | 93.3% | 95.1% | 97.3% | 99.0% |
| | 4 slpm | | | |
| Outlet $O_2$ | 18% | 15% | 10% | 5% |
| Filling duration | 18.8 | 19.5 | 20.4 | 21.4 |
| Gas loss | 10.0% | 11.6% | 14.8% | 19.7% |
| Gas fill | 94.7% | 96.8% | 98.4% | 99.0% |
| | 6 slpm | | | |
| Outlet $O_2$ | 18% | 15% | 10% | 5% |
| Filling duration | 13 | 13.4 | 13.8 | 14.9 |
| Gass Loss | 13.5% | 14.5% | 17.5% | 26.3% |
| Gass fill | 95.1% | 97.2% | 97.5% | 97.9% |
| | 8 slpm | | | |
| Outlet $O_2$ | 18% | 15% | 10% | 5% |
| Filling duration | 9.9 | 9.9 | 10.5 | 11.6 |
| Gas loss | 17.2% | 15.1% | 22.2% | 30.3% |
| Gas fill | 93.5% | 95.3% | 95.1% | 98.6% |

TABLE 5

Filling of medium IGU

| | | | | |
|---|---|---|---|---|
| | 2 slpm | | | |
| Outlet $O_2$ | 18% | 15% | 10% | 5% |
| Filling duration | 80.7 | 83 | 88.7 | 96.3 |
| Gas loss | 7.9% | 6.9% | 11 .4% | 19.3% |
| Gas fill | 91.8% | 95.4% | 97.7% | 99.1% |

TABLE 5-continued

| Filling of medium IGU | | | | |
|---|---|---|---|---|
| | 4 slpm | | | |
| Outlet $O_2$ | 18% | 15% | 10% | 5% |
| Filling duration | 42.6 | 43.6 | 47 | |
| Gass loss | 10.4% | 10.4% | 17.2% | |
| Gass fill | 94.7% | 97.0% | 98.5% | |
| | 6 slpm | | | |
| Outlet $O_2$ | 18% | 15% | 10% | 5% |
| Filling duration | 28.3 | 30.1 | 31 | |
| Gass loss | 8.5% | 13.4% | 15.4% | |
| Gass fill | 96.1% | 97.7% | 98.9% | |
| | 8 slpm | | | |
| Outlet $O_2$ | 18% | 15% | 10% | 5% |
| Filling duration | 22.6 | 22 | 24 | |
| Gas loss | 15.7% | 11.1% | 19.7% | |
| Gass fill | 96.0% | 97.3% | 98.4% | |
| | 10 slpm | | | |
| Outlet $O_2$ | 18% | 15% | 10% | 5% |
| Filling duration | 18.2 | 18.5 | 18.8 | |
| Gass loss | 15.0% | 16.3% | 17.7% | |
| Gass fill | 97.1% | 97.7% | 98.1% | |
| | l2 slpm | | | |
| Outlet $O_2$ | 18% | 15% | 10% | 5% |
| Filling duration | 14.9 | 15.2 | 16.6 | 17.7 |
| Gas loss | 14.0% | 16.0% | 25.6% | 33.3% |
| Gas fill | 96.3% | 96.5% | 97.3% | 97.8% |
| | 14 slpm | | | |
| Outlet $O_2$ | 18% | 15% | 10% | 5% |
| Filling duration | 12.8 | 13.3 | 14.2 | 15.3 |
| Gas loss | 16.9% | 18.0% | 25.7% | 34.6% |
| Gasfill | 94.1% | 96.9% | 97.1% | 97.7% |
| | 16 slpm | | | |
| Outlet $O_2$ | 18% | 15% | 10% | 5% |
| Filling duration | 11 | 11.8 | 12.7 | |
| Gas loss | 12.5% | 20.1% | 27.8% | |
| Gas fill | 96.0% | 96.5% | 97.6% | |

TABLE 6

| Filling of large IGU | | | | |
|---|---|---|---|---|
| | 8 slpm | | | |
| Outlet $O_2$ | 18% | 15% | 10% | 5% |
| Filling duration | 46.5 | 47.6 | | |
| Gass loss | 2.1% | 3.4% | | |
| Gass fill | 97.3% | 98.3% | | |
| | 10 slpm | | | |
| Outlet $O_2$ | 18% | 15% | 10% | 5% |
| Filling duration | | | | |
| Gas loss | | | | |
| Gas fill | | | | |
| | 12 slpm | | | |
| Outlet $O_2$ | 18% | 15% | 10% | 5% |
| Filling duration | 32.1 | 33.3 | | |
| Gas loss | 4.6% | 7.5% | | |
| Gas fill | 98.3% | 99.2% | | |

TABLE 6-continued

| Filling of large IGU | | | | |
|---|---|---|---|---|
| | 14 slpm | | | |
| Outlet $O_2$ | 18% | 15% | 10% | 5% |
| Filling duration | | | | |
| Gas loss | | | | |
| Gas fill | | | | |
| | 16 slpm | | | |
| Outlet $O_2$ | 18% | 15% | 10% | 5% |
| Filling duration | 24.6 | 25 | | |
| Gas loss | 6.9% | 7.3% | | |
| Gas fill | 98.3% | 99.5% | | |
| | 20 slpm | | | |
| Outlet $O_2$ | 18% | 15% | 10% | 5% |
| Filling duration | 20 | 20.6 | | |
| Gas loss | 7.7% | 11.4% | | |
| Gas loss vs. Ref | 12.0% | 17.8% | | |
| Vol. gas vs. IG Vol | 1.07 | 1.10 | | |
| Gas fill | 99.2% | 98.7% | | |

One of ordinary skill in the art will recognize that not each of the permutations of threshold Oxygen concentration and flow rates need to be performed. A more complete, and therefore robust, set of will be produced by performing each of the permutations of threshold Oxygen concentration and flow rate. Although the filling of each of the square IGUs should be ideally be performed for each of the permutations, it was not in actuality performed in this Example. It will be noted that the smallest square IGU was not filled at filling flow rates higher than 8 slpm because a point of limiting returns was observed upon recording the data for the filling flow rate of 8 slpm. It will also be noted that the medium and largest square IGUs were not filled until some of the lower $O_2$ threshold levels were sensed (5% in the case of the medium square IGU and both 5% and 10% in the case of the largest square IGU) because a point of limiting returns was observed upon recording the data for an $O_2$ threshold level of 10% in the case of the small square IGU and 15% in the case of the largest square IGU.

The optimal filling flow rate may be determined in a variety of different ways from the data by applying artificial restraints upon the $O_2$ threshold level and one measured filling variable (filling duration or gas loss or final interpane gas concentration) and then selecting the flow rate which corresponds to an optimal level of another characteristic (filling duration or gas loss or final interpane gas concentration).

For example, the $O_2$ threshold level could be constrained to 18%. This means that only the data corresponding to those recorded at an $O_2$ threshold level of 18% were selected and application of the model to a differently sized IGU is performed by filling that differently sized IGU until a threshold $O_2$ level of 18% is sensed by the sensor. Next, the filling duration could be constrained to all filling durations of 20 sec or less. Then, the remaining data corresponding to an $O_2$ threshold level of 18% and a filling duration of 20 sec or less was reviewed to determine which filling rate resulted in the lowest gas loss (4 slpm for a 10% loss) for that limited set of data or the highest final interpane gas concentration (6 slpm for a concentration of 95.1%). The same artificial constraints are placed upon the data collected for the other square IGUs. The selected optimal filling flow rates for each size of square IGU are than plotted against the dimensions (width) of those square IGUs. Next, the plotted chart may be used to calculate an optimal filling flow rate for a differently sized IGU. Take for example, an IGU to be filled having a width of 20" and a height of 40". The normalized dimension corresponding to a square IGU having an area (height×width) of 800 square inches is 28.28 inches. The filling flow rate on the line plotted on the chart corresponding to a dimension of 28.28 inches is the optimal filling flow rate yielded by the model.

As discussed earlier, the optimal filling flow rate may be determined in a wide variety of ways and practice of the invention need not be limited to plotting data corresponding to an 18% $O_2$ threshold level, a filling duration of 20 sec or less, and a minimum gas loss.

Figure 5:
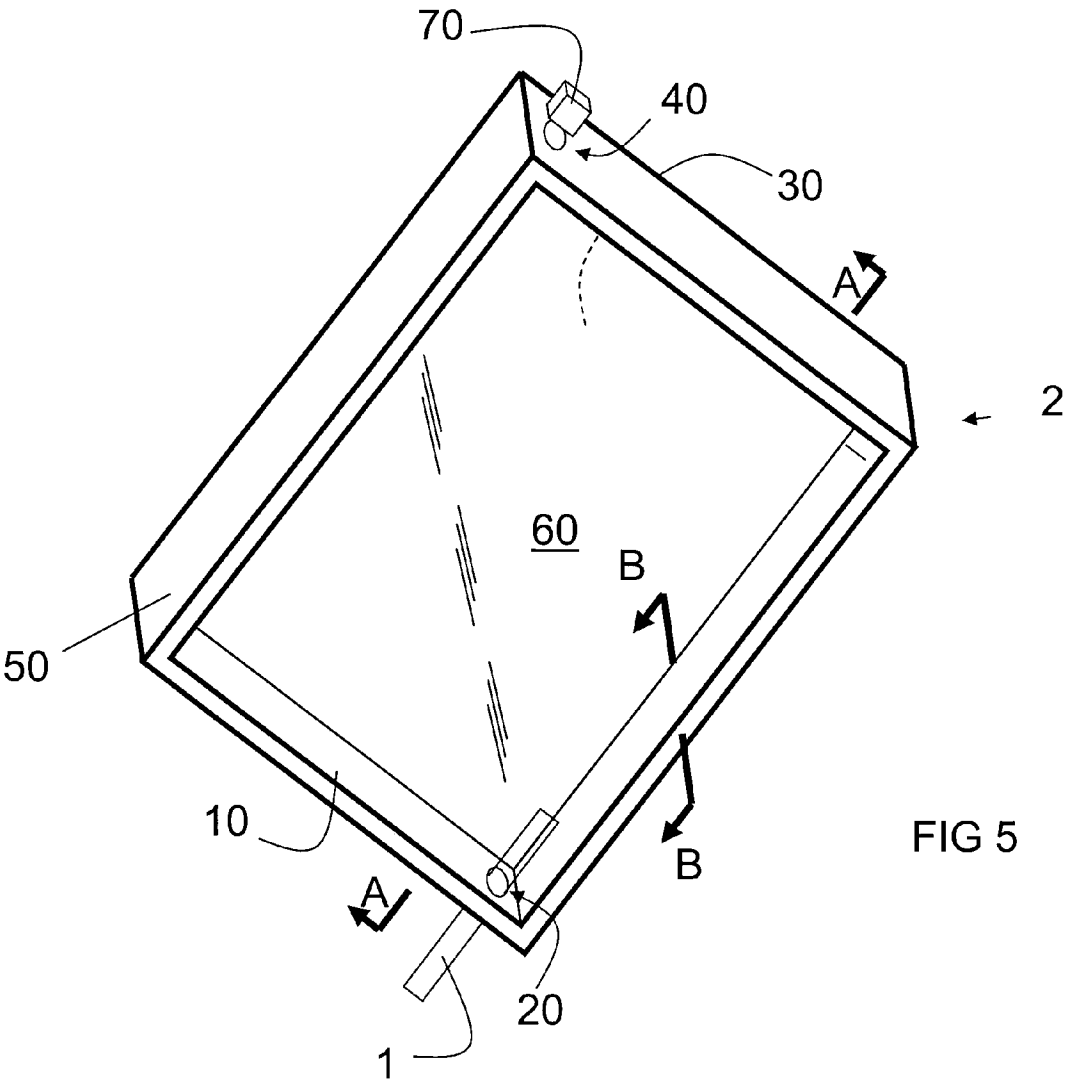
FIG. 5 is a schematic of the enclosure of FIG. 1 wherein the filling is performed at 45°.

FIG. 7 shows the selection of the optimum Kr filling conditions for the small and medium size square IGUs conducted at a 45° angle (as illustrated in FIG. 5). At 18% $O_2$ content (equivalent to 13.9% Kr), for a particular window size, there is an optimum flow rate that guarantees the maximum Krypton content (e.g. 6 slpm for 14"×14"×(⅜)" window).

EXAMPLE 6

Example 6 gives an example of Decision Support Tool specifically tailored for the filling of ⅜" thick interpane and which ensured that the maximum gas loss does not exceed 15%. The constraints used for the Decision Support Tool were [Outlet O2 content threshold] & [maximum gas fill]. The Decision Support Tool is based on experimental data (data encircled by dotted lines in Tables 4-6). Specifically, the filling of three square units (small size, medium size and large size) was investigated over a range of flow rates and outlet stream oxygen content. As seen in Table 7, the following conditions were selected from Tables 4-6 in order to guaranty at least 95% krypton fill prior to the sealing of each interpane along with gas loss of 15% or lower. The Decision Support Tool tailored for a minimum 95% krypton filling of a ⅜" interpane conducted at a 45° angle (as illustrated in FIG. 5) is graphed in FIG. 8.

TABLE 7

Optimum condition to guaranty a short filling at 95% Kr content. In this case, the ending criterion for the filling is 18% $O_2$ in the outlet gas stream.

| | Small Size | Medium Size | Large Size |
|---|---|---|---|
| Window Dimension | 14" × 14" × ⅜" | 21" × 21" × ⅜" | 32" × 32" × ⅜" |
| Filling Duration (sec) | 13 | 18.2 | 24 |
| Flow Rate of Filling (slpm) | 6 | 10 | 16 |
| Outlet O2 Content | 18% | 18% | 18% |
| Gas Loss | 13.5% | 15.0% | 6.9% |
| Gas Content | 95.1% | 97.1% | 98.3% |

The Decision Support Tool was then tested on a larger window of dimensions 22"×36"×(⅜)". The filling process was a two-hole process (one bottom hole, one top hole to evacuate the leaving gas) with no vacuum being applied at the outlet port. Table 8 represents the results:

TABLE 8

Use of the 18% Outlet $O_2$ content model for the filling of a rectangular double pane window.

| | Window Dimension | |
|---|---|---|
| | 21" × 21" × ⅜" | 22" × 36" × ⅜" |
| Filling Duration (sec) | 18.2 | 31 |
| Flow Rate of Filling (slpm) | 10 | 10.4 |
| Outlet O2 Content | 18% | 18% |
| Gas Loss | 15.0% | 8.4% |
| Gas Content | 97.1% | 97.9% |

EXAMPLE 7

Example 7 gives an example of a Decision Support Tool specifically tailored for the filling of ⅜" thick interpane which is conducted at a 45° angle (as illustrated in FIG. 5) and ensures a minimum Krypton filling of 97% prior to sealing the interpane (see FIG. 9). This Decision Support Tool is based on experimental data (data encircled by solid lines in Tables 4-6). Specifically, the filling of three square units (small size, medium size and large size) was investigated over a range of flow rates and outlet stream Oxygen content. The following conditions were chosen for each size (see Table 9) in order to guarantee at least 97% Krypton fill (per volume) prior to the sealing of each interpane.

TABLE 9

Optimum condition to guaranty a short filling at 97% Kr content

| | 97% Gas Fill | | |
|---|---|---|---|
| | Small Size | Medium Size | Large Size |
| Window Dimension | 14" × 14" × ⅜" | 21" × 21" × ⅜" | 32" × 32" × ⅜" |
| Filling Duration (sec) | 13.8 | 18.5 | 24 |
| Flow Rate of Filling (slpm) | 6 | 10 | 16 |
| Outlet $O_2$ Content | 10% | 15% | 18% |
| Gas Loss | 17.5% | 16.3% | 6.9% |
| Gas Content | 97.5% | 97.7% | 98.3% |

The previous Decision Support Tool was then tested on a larger window of dimensions 22"×36"×⅜". The filling process was a two-hole process (one bottom hole, one top hole to evacuate the leaving gas) with no vacuum being applied at the outlet port. Table 10 represents the results.

TABLE 10

Use of the 97% minimum gas fill model on a rectangular interpane.

| | 97% Gas Fill | |
|---|---|---|
| Window Dimension | 21" × 21" × ⅜" | 22" × 36" × ⅜" |
| Filling Duration (sec) | 18.5 | 32 |
| Flow Rate of Filling (slpm) | 10 | 10.4 |
| Outlet $O_2$ Content | 15% | 15% |
| Gas Loss | 16.3% | 11.3% |
| Gas Content | 97.7% | 98.5% |

Preferred processes and apparatus for practicing the present invention have been described. It will be understood and readily apparent to the skilled artisan that many changes and modifications may be made to the above-described embodiments without departing from the spirit and the scope of the present invention. The foregoing is illustrative only and that other embodiments of the integrated processes and apparatus may be employed without departing from the true scope of the invention defined in the following claims.

What is claimed is:

1. A method of filling an enclosure with a filling gas, comprising the steps of:

providing an enclosure having an interior, a width, a height, a thickness, and fluid filling and exit holes fluidly communicating with the interior;

commencing filling of the enclosure by directing a flow of the filling gas at a filling flow rate into the fluid filling hole;

sensing an oxygen concentration of gas exiting the fluid exit hole; and stopping said filling of the enclosure when the sensed oxygen concentration reaches a threshold concentration, wherein the threshold oxygen concentration and/or the filling flow rate are selected by a Decision Support Tool based upon the width, height, and/or the thickness, the method further comprising the steps of:

causing the height and/or width to be inputted to a controller;

selecting the filling flow rate with the controller, wherein the Decision Support Tool is an algorithm written to the controller.

2. The method of claim 1, wherein the threshold oxygen concentration is predetermined and the filling flow rate is selected by the Decision Support Tool based upon the width, height, and/or the thickness.

3. The method of claim 1, wherein the filling flow rate is predetermined and the threshold oxygen concentration is selected by the Decision Support Tool based upon the width, height, and/or the thickness.

4. The method of claim 1, wherein both the filling flow rate and the threshold oxygen concentration are selected by the Decision Support Tool based upon the width, height, and/or the thickness.

5. The method of claim 4, further comprising the steps of:

predetermining a minimum concentration of the filling gas to be obtained inside the enclosure;

predetermining a maximum percent loss of the filling gas to occur during said filling, wherein the filling flow rate and threshold oxygen concentration selected by the Decision Support tool are further based upon the predetermined minimum concentration and predetermined maximum percent loss.

6. The method of claim 1, further comprising the step of predetermining a minimum concentration of the filling gas to be obtained inside the enclosure, wherein the filling flow rate or threshold oxygen concentration selected by the Decision Support Tool is further based upon the predetermined minimum filling gas concentration.

7. The method of claim 1, further comprising the step of predetermining a maximum percent loss of the filling gas to occur during said filling, wherein the filling flow rate or threshold oxygen concentration selected by the Decision Support Tool is further based upon the predetermined maximum percent loss.

8. The method of claim 1, further comprising the step of predetermining a maximum filling duration defined by a time interval between said commencement and stopping of the filling, wherein the filling flow rate or threshold oxygen concentration selected by the Decision Support Tool is further based upon the predetermined maximum filling duration.

9. The method of claim 1, wherein the Decision Support Tool selects the flow rate of the filling gas based the width, height, and/or the thickness and a composition of the filling gas.

10. The method of claim 1, wherein the enclosure is an insulated glass unit comprising at least two square, triangular, semicircular or rectangular glass panes aligned with and parallel to one another and a sealing structure extending around a periphery of the panes and over an interpane space defined by the panes, the fluid filling and exit holes being formed in the sealing structure adjacent opposite corners of the sealing structure.

11. The method of claim 1, wherein during said filling of the enclosure a bottom edge of the enclosure forms an angle a with respect to horizontal, said angle a being in a range of from 1° to 179°, the fluid exit hole being higher vertically than the fluid filling hole.

12. The method of claim 11, wherein a is in a range of from 5° to 175°.

13. The method of claim 1, wherein the oxygen concentration is sensed by an optically-based oxygen sensor.

14. The method of claim 13, wherein a response time of the sensor is less than 1 second.

15. The method of claim 13, wherein the sensor is disposed inside, or adjacent to, the fluid exit hole.

16. The method of claim 1, wherein the filling gas is selected from the group consisting of Argon, Argon-enriched air, Neon, Neon-enriched air, Krypton, Krypton-enriched air, Xenon, Xenon-enriched air, and mixtures thereof.

17. The method of claim 1, further comprising the step of applying a vacuum to the fluid exit hole, wherein:

the threshold oxygen concentration is selected by the Decision Support Tool based upon the width, height, and/or the thickness;

the filling flow rate is predetermined based upon a filling flow rate selected by an operator that compensates for the increase in the flow of filling gas through the enclosure that is produced by said vacuum application.

18. A system for filling an enclosure with a filling gas, comprising:

a filling lance adapted to be inserted into a fluid filling hole formed in one end of the enclosure;

an oxygen sensor disposed adjacent a fluid exit hole formed in an opposite end of the enclosure; and a controller being written with an algorithm, said controller being adapted to:

receive an oxygen concentration sensed by said oxygen sensor, have a height, width and/or a thickness of the enclosure be inputted, select a flow rate of the filling gas during filling of the enclosure and/or a threshold oxygen concentration, said selection being based upon the height, width and/or a thickness of the enclosure to be filled that is inputted to the controller, the selection being performed by the algorithm, and stop filling of the enclosure by said filling lance once the oxygen concentration sensed by said oxygen sensor reaches the threshold oxygen concentration that is either selected by the algorithm or predetermined and inputted to the controller by an operator.

19. The system of claim 18, further comprising a source of filling gas fluidly communicating with said filling lance, said filling gas being selected from the group consisting of Argon, Argon-enriched air, Neon, Neon-enriched air, Krypton, Krypton-enriched air, Xenon, Xenon-enriched air, and mixtures thereof.

20. The system of claim 18, wherein the controller is further adapted to have a filling parameter inputted by an operator thereinto, said filling parameter being selected from the group consisting of a minimum concentration of the filling gas to be obtained in the enclosure, a maximum percent loss of the filling gas to occurs during filling, a maximum filling duration defined by a time interval between commencement and stopping of filling the enclosure with the filling gas, and a composition of the filling gas, wherein the flow rate is further based upon said filling parameter.

21. The method of claim 18, further comprising a vacuum tube and a vacuum pump in vacuum communication with said tube, said sensor being at least partially disposed within said vacuum tube, said tube being adapted to be placed in vacuum communication with the fluid exit hole.

* * * * *